US010679594B2

(12) United States Patent
Schmidt et al.

(10) Patent No.: US 10,679,594 B2
(45) Date of Patent: Jun. 9, 2020

(54) MUSICAL INSTRUMENT STAND, PARTICULARLY A MULTIPLE GUITAR STAND, WITH SUPPORT ELEMENTS

(71) Applicant: Hans-Peter Wilfer, Markneukirchen (DE)

(72) Inventors: Roland Schmidt, Heidelberg (DE); Klaus Lackner, Heidelberg (DE)

(73) Assignee: Hans-Peter Wilfer, Markneukirchen (DE)

( * ) Notice: Subject to any disclaimer, the term of this patent is extended or adjusted under 35 U.S.C. 154(b) by 0 days.

(21) Appl. No.: 15/877,951

(22) Filed: Jan. 23, 2018

(65) Prior Publication Data

US 2020/0027429 A1 Jan. 23, 2020

(30) Foreign Application Priority Data

Jan. 16, 2018 (EP) ..... 18151860

(51) Int. Cl.
*G10G 5/00* (2006.01)
*A47B 46/00* (2006.01)
(Continued)

(52) U.S. Cl.
CPC ..... *G10G 5/00* (2013.01); *A47B 46/00* (2013.01); *A47F 5/0037* (2013.01); *A47F 7/0028* (2013.01)

(58) Field of Classification Search
CPC ..... A47B 19/002; A47B 81/00; A47B 81/005; A47B 45/00; A47B 46/00; A47B 47/00;
(Continued)

(56) References Cited

U.S. PATENT DOCUMENTS 587,147 A * 7/1897 Hein ..... B62H 3/04 211/21
620,863 A * 3/1899 Wilcox ..... B62H 3/04 211/21

(Continued)

FOREIGN PATENT DOCUMENTS

DE 102010052584 B3 * 4/2012 ..... G01G 5/00
DE 202013100823 U1 * 3/2013 ..... G01G 5/00

OTHER PUBLICATIONS https://reverb.com/item/1266570-quik-lok-universal-multiple-guitar-stand-holds-7-guitars?gclid=EAlalQobChMlivKlndm85Q1VgpyzCh3hvgl6EAQYCCABEgJd-vD_BwE&gclsrc=aw.ds&merchant_id=124038637&pla=1&utm_campaign=6482957710&utm_medium=pla&utm_source=google (Year: 2019).*

*Primary Examiner* — Jennifer E. Novosad
(74) *Attorney, Agent, or Firm* — Scarinci Hollenbeck, LLC; Libby Babu Varghese

(57) ABSTRACT

A stand (1), particularly a multiple guitar stand, comprising a rack (10) and at least one pair of support elements (20*a*, 20*b*) capable of being mounted on rack (10) having respectively one support surface (210*a*, 210*b*) for the body of the musical instrument, wherein rack (10) has a support frame (11) with two support rails (12*a*, 12*b*) running parallel to one another having a respectively non-rotationally symmetrical, especially polygonal, cross-sectional shape (Q1) and a contact bracket (14) connected to support frame (11), preferably capable of being pivoted, wherein contact bracket (14) has a contact rail (15) running parallel to support rails (12*a*, 12*b*) and at least one support arm (16, 17) connecting contact rail (15) respectively to support frames (11), wherein contact rail (15) defines at least one contact surface (31) for the neck of the musical instrument directly or through contact elements (30) capable of being mounted on contact rail (15). Support
(Continued)

elements (20*a,* 20*b*) respectively have a mounting recess (24) adapted to cross-sectional shape (Q1) of support rails (12*a,* 12*b*).

17 Claims, 17 Drawing Sheets

(51) Int. Cl.
*A47F 7/00* (2006.01)
*A47F 5/00* (2006.01)

(58) Field of Classification Search
CPC ..... A47B 47/02; A47B 47/021; A47F 5/10; A47F 7/0021; A47F 7/0028; A47F 5/0037; G10G 5/009
USPC ..... 211/2, 85.6, 85.7, 20–22, 175, 60.1, 211/71.01, 168, 169; 206/314; 84/327
See application file for complete search history.

(56) References Cited

U.S. PATENT DOCUMENTS 648,402 A * 5/1900 Haarmann et al. ..... B62H 3/04 211/21
2,058,184 A * 10/1936 Sherrard ..... G10G 5/00 211/20
3,540,752 A * 11/1970 Anuskiewicz ..... B62B 5/0083 280/35
4,205,818 A * 6/1980 Lawler ..... A47B 19/002 211/85.6
4,352,480 A * 10/1982 Gathright ..... G10G 5/00 206/314
4,986,158 A * 1/1991 Johnson ..... F16M 11/22 84/327
5,165,552 A * 11/1992 Muhlbauer ..... A47F 7/00 211/133.1
D407,240 S * 3/1999 Payne ..... D17/99
5,988,402 A * 11/1999 Mayfield ..... B62H 3/04 211/20
6,296,213 B1 * 10/2001 Law, III ..... G10G 5/00 206/45.2
D464,508 S * 10/2002 Wilfer ..... D6/552
6,540,182 B1 * 4/2003 Wilfer ..... G10G 5/00 211/85.6
6,640,979 B1 * 11/2003 Mayfield ..... B62H 3/00 211/20
6,800,798 B2 * 10/2004 Hsieh ..... G10G 5/00 84/327
7,717,377 B1 * 5/2010 Corrado ..... G10G 5/00 248/125.9
D650,611 S * 12/2011 Melhart ..... D6/682.4
8,167,148 B2 * 5/2012 Jacobson ..... A47B 81/00 108/193
D675,039 S * 1/2013 Foisy ..... D6/682.1
D679,117 S * 4/2013 Werner ..... D6/682.4
8,490,942 B1 * 7/2013 Henry ..... G10G 5/00 206/314
8,622,226 B2 * 1/2014 Colwell ..... A47B 81/00 211/85.6
D702,065 S * 4/2014 Moore ..... D6/682.4
8,770,535 B1 * 7/2014 Yu ..... G10G 5/00 211/85.6
D782,227 S * 3/2017 Hepburn ..... D6/674
2004/0144233 A1 * 7/2004 Hsieh ..... G10G 5/00 84/327
2004/0237755 A1 * 12/2004 Laio ..... F16B 7/105 84/327
2005/0230334 A1 * 10/2005 MacDonald ..... A47B 43/00 211/64
2006/0131251 A1 * 6/2006 Stadler ..... E04B 1/8236 211/85.6
2009/0184074 A1 * 7/2009 Jacobson ..... A47B 81/00 211/85.6
2010/0163693 A1 * 7/2010 Wang ..... G10G 5/00 248/121
2011/0253655 A1 * 10/2011 Mone ..... G10G 5/00 211/85.6
2015/0129523 A1 * 5/2015 Cortina ..... G10G 5/00 211/85.6
2017/0309262 A1 * 10/2017 Walker ..... G10G 5/00
2020/0027429 A1 * 1/2020 Schmidt ..... G10G 5/00

* cited by examiner

MUSICAL INSTRUMENT STAND, PARTICULARLY A MULTIPLE GUITAR STAND, WITH SUPPORT ELEMENTS

This application claims priority to the European Patent Office application No. 18151860.6 filed on Jan. 16, 2018.

BACKGROUND

The invention relates to a musical instrument stand, particularly a multiple guitar stand, in accordance with the preamble of Claims 1, 15, and 17, as well as a support element according to claim 14.

Stands for multiple musical instruments having a body and a neck, such as guitars or bass guitars, are fell-known from the state of the art. Particularly guitarists and bassists own and frequently use different guitars and bass guitars, which they would like to set aside for storage or to have ready for use in a rehearsal studio or on a stage in a musical instrument stand. Particularly high-quality musical instruments are delicate and have to be carefully set aside, i.e. propped up or leaned against something. Musical instrument stands should therefore, on one hand, ensure that the instrument set aside is not damaged, in particular that it does not fall over or become scratched, and, on the other hand, enable easy access to the instrument for a fast and smooth change of instruments.

A musical instrument stand for storing one or more musical instruments having a body and a neck, such as guitars, is well-known from DE 10 2010 052 584 B3. On two parallel side members that are spaced from each other, spacers and crossbars are alternately arranged, which are slid onto the side members. The crossbars connect the side members to each other and are intended to both prevent contact between the musical instruments placed on the spacers as well as to prevent the musical instruments from turning and falling out between the side members. By putting the end-side crossbars on end sections, the alternately arranged spacers are braced together on the side members and retained so they cannot move.

This type of musical instrument stand has multiple disadvantages. Firstly, the position of the spacers and crossbars on the side member is set. Secondly, only a precisely defined number of spacers and crossbars can be used with respectively predetermined lengths, which have to be accurately coordinated to the overall length of the side members. In addition, the musical instrument stand known is not suited for all body styles of musical instruments available.

Overall, the musical instrument stands known from the state of the art do not satisfactorily meet the stringent demands of musicians for individual adaptability and flexible usability.

SUMMARY OF THE INVENTION

Overall, the musical instrument stands known from the state of the art do not satisfactorily meet the stringent demands of musicians for individual adaptability and flexible usability.

The present invention therefore has the objective of providing a musical instrument stand that can be used more flexibly. In particular, the musical instrument stand should be adaptable for a number of different types of musical instruments having at least one body and one neck, preferably as easily as possible. In addition, musical instruments should be able to be set aside, in particular, without damaging them.

This object is achieved through a musical instrument stand according to Claims 1, 15, and 17, as well as through a support element according to Claim 14.

The object is achieved in particular through a musical instrument stand, especially a multiple guitar stand, for holding at least one musical instrument having a body and a neck, particularly a guitar and/or a bass guitar, wherein the musical instrument stand comprises a rack and at least a pair of support elements capable of being mounted on the rack having respectively one support surface for the body of the musical instrument, wherein the rack has a support frame with two support rails running parallel to each other having a respectively non-rotationally symmetrical, especially polygonal, cross-section shape and a contact bracket connected to the support frame, preferably so that it can pivot, wherein the contact bracket has a contact rail running parallel to the support rails and at least one support arm connecting the contact rail respectively to the support frames, wherein the contact rail defines at least one contact surface for the neck of the musical instrument directly or via contact elements capable of being mounted on the contact rail, wherein the support elements have respectively one mounting recess adapted to the cross-section shape of the support rails for fastening each support element on a support rail in at least one support arrangement set by being rotated relative to the support rail.

Particularly a support rail has a longitudinal axis, wherein the support rail has a non-rotationally symmetrical cross-section shape or a non-rotationally symmetrical cross-sectional profile in a plane vertical to the longitudinal axis. A non-rotationally symmetrical cross-section shape of the support rail can mean a cross-section shape that is not congruent with itself in the case of a rotation (turning) at any angle about the longitudinal axis of the support rail. For example, the cross-section shape can be polygonal, especially rectangular, oval, elliptical, cross-shaped, T-shaped or an elongated cross-section with semicircular narrow sides (shape of an oblong hole). In particular, the cross-section shape is not circular. In particular, a form fit can be achieved between a support rail and a mounting recess. In particular, the cross-section shape of the support rail corresponds at least essentially to a cross-section or a contour of the mounting recess.

A support element is preferably designed to support the body of a musical instrument in the vertical direction (vertical to the support rail) and in the lateral direction (longitudinally to the support rail). Support elements are preferably not connected together among each other and can be arranged on support rails so that they can slide axially—at least when a minimum longitudinal force is applied. The cross-section shapes of both support rails and the mounting recesses of the support elements (all support elements) are preferably identical. Both support elements of a pair are particularly capable of being mounted on each of the two support rails. A support element can be mounted on a support rail in multiple support arrangements set by being rotated relative to the support rail, particularly in two different support arrangements. Three or four different support arrangements can also be designed.

A support element can have a one-piece or multi-piece design, wherein, particularly with respect to the longitudinal axis of a support rail, inner and outer elements of a support element and/or, with respect to the longitudinal direction of a support rail, consecutively arranged elements of a support element can be designed. A musical instrument stand can comprise different support elements, particularly pairs of support elements, which may differ particularly in their length, the form of their support surface, and/or through their material or materials, and can be adjusted particularly to the body shape of one or more specific musical instruments. In particular, a support element, or an element of a support element, can comprise multiple materials.

Support arms are preferably provisioned on both sides of the musical instrument stand, which form a contact bracket with the contact rail. However, a single center or lateral support arm is also conceivable, to which the contact rail can be connected in a T-shape or an L-shape.

A musical instrument stand according to the invention has the advantage that a support element, or a pair of (opposing) support elements, can be fastened in any axial position on a support rail or pushed there, for example if a specific gap is desired or necessary between adjacent resting musical instruments. In addition, the number of support elements mounted on a support rail can be freely chosen, as each support element can itself set its rotating position through the mounting recess, i.e. independently from additional potentially present support elements. Moreover, individual support elements can be replaced if necessary without having to adapt other support elements. Support elements of a varying length and shape can be replaced by each other and combined with each other. The musical instrument stand can be variably configured in respectively at least one support arrangement through the assembly of various support elements. In addition, separate fasteners can be eliminated the fastening a support element on a support rail so that it cannot rotate, whereby the assembly is simplified. Overall, flexibility and adaptability are enhanced by a musical instrument stand according to the invention.

In a beneficial embodiment of the invention, each support element is designed so that it can be mounted on the support rails in a first support arrangement set by being rotated relative to the support rail, particularly for supporting a first musical instrument, and a second support arrangement set by being rotated relative to the support rail, particularly for supporting a second musical instrument that differs from the first musical instrument, wherein the first and the second support arrangement are preferably rotated opposite each other at an angle between 60° and 120°, preferably by 90°. The angle can be particularly between 70° and 110°, between 80< and 100° or between 85° and 95°. Particularly the support surfaces of the support elements of a pair face each other in a first support arrangement (V-shaped arrangement of the support surfaces) and away from each in a second support arrangement (A-shaped arrangement of the support surfaces), wherein they preferably collectively comprise an angle of between 60° and 120°, preferably of 90°. Different support arrangements of a support element are achievable particularly by attaching it in the opposite direction with respect to the longitudinal direction of the support rail (reverse), by attaching it in another rotational angle position with respect to the longitudinal axis of the support rail (pushed on or clamped on rotated) or by attaching a support element on the respectively other support rail (interchange or replacement). Through various support arrangements of a support element, the musical instrument stand can be adapted to various types of musical instruments, particularly guitars with different body shapes, e.g. round (V-shaped arrangement of the support surfaces) or V-shaped bodies (A-shaped arrangement of the support surfaces).

In a beneficial embodiment of the invention, the support surface defines a bearing plane, which runs diagonally, particularly rotated by between 30° and 60°, preferably by 45', to a symmetrical axis of the mounting recess. Bearing planes preferably run diagonally to the horizontal line. As a result, the support rails can be aligned differently than the desired bearing planes.

In a beneficial embodiment of the invention, the mounting recess is arranged in a support element eccentrically, particularly displaced with respect to a center axis of the support element. A center axis can be understood as running vertically to the longitudinal axis of the support rail when the support element is assembled. In particular, the support surface extends on one side away from the mounting recess or projects towards the longitudinal axis of the support rail. In this way, a larger support surface of a support element, particularly a greater span between both support surfaces of a pair of opposing support elements is achieved, through which a musical instrument can be support more securely.

In a beneficial embodiment of the invention, the support rail has a non-rotationally symmetrical, especially polygonal, cross-section shape, wherein the contact element has a mounting recess adapted to the cross-section shape of contact rail for mounting the contact element on the contact rail. In particular, the contact element has lateral support surfaces next to the contact surface for the lateral securing of a neck of the allocated musical instrument. The contact surfaces of the contact elements can be adapted to a specific neck geometry of the allocated musical instrument. A contact element can have an indentation for forming the contact surface. A contact element can also have a double indentation with a center protrusion, particularly for long embodiments of contact elements, for example in order to support the neck of a guitar, particularly an acoustic guitar, in both possible holding orientations. The contact element is preferably made as one piece, for example from a thermoplastic elastomer (TPE). This type if contact element has similar benefits as were already explained in conjunction with the support elements. In particular, a contact element can be freely positioned or shifted in the axial direction of the contact rail, especially independent of other provisioned contact elements. Separate fasteners for mounting a contact element on the contact rail so they it cannot rotate can be eliminated, which simplifies the assembly.

In a beneficial embodiment of the invention, the mounting recess of the support elements and/or the contact elements is designed as a passage opening or a spring clip, wherein the support elements and/or the contact element can be pushed in the longitudinal direction or clamped in the transverse direction particularly onto the support rails or the contact rail. The support elements and/or the contact element can also be designed so they are capable of being attached or clipped on. In this manner, a positive connection secured against rotation is achieved between the mounting recess and the support rail. A spring clip (clip) can be engineered particularly from, an (in the area of the mounting recess) elastic material and with a mounting recess of the support element open on one side. The assembly of the support elements or the contact elements is simplified due to a shifting or clamping thereof. Separate fastening elements, such as screws, can be eliminated.

In a beneficial embodiment of the invention, the support element forms a central support surface for supporting a body of a musical instrument and two opposing lateral support surfaces for restricting the lateral movement of the body of the musical instrument. Due to the central support surface, the body of the musical instrument can be supported particularly in the vertical direction. Due to the lateral support surfaces, a lateral rotation of the body of the musical instrument is prevented or at least restricted by the support element.

In a beneficial embodiment of the invention, a support element is designed in one area of the mounting recess more rigidly, preferably from a material with a higher rigidity, than in the area of the central support surface and/or in the area of the lateral support surfaces. In particular, the support element preferably has a bend-resistant and/or torsion-resistant design in the area of the mounting recess and preferably a soft elastic design in the area of the lateral support surfaces. The rigidity of the support element can, be determined by area due to its (inner) structure and through the materials used. A one-piece support element could be made for particular areas from other material components or another material structure, for example from fine-pored foam for a higher rigidity and from coarse-pored foam for a lower rigidity. The support element can be designed for particular areas as hollow, optionally having an inner pore, brace or honeycomb structure so as to be flexible or elastic in particular areas. The individual elements of a multi-component support element can be made from materials of a varying rigidity. In the area of the mounting recess, the support element is designed particularly sufficiently rigid in order to prevent the support element from rotating relative to the support rail under the weight of a rested musical instrument. In the area of the support surface, the support element is beneficially designed to be soft and elastic in order to adapt to the contour of the body of the rested musical instrument at least in particular areas and in particular to not damage it.

In a beneficial embodiment of the invention, the support element has a center element and two side elements arranged on both sides of the center element, preferably capable of being connected to the center element, wherein the center element preferably forms the central support surface and the lateral support surfaces, wherein the center element is especially designed to be soft and elastic, particularly comprising an elastomer, preferably a thermoplastic elastomer (TPE). Thus, different functions of the support element can be adopted respectively by the individual elements of the support element, particularly the direct contact with the musical instrument and the connection of the support element to the support rail.

In another beneficial embodiment of this aspect of the invention, the side element forms the mounting recess, wherein the side element is designed to be especially bend-resistant and/or torsion-resistant, particularly consisting of a thermoplastic, preferably polyamide. For example, a side element is made from PA6. A bend-resistant and/or torsion-resistant side element has an adequate stability to prevent bending or rotating relative the support rails.

A support element having a center element and two side elements bears the advantage that the individual elements can be produced separately, particularly from different materials. Thus, the different functions of a support element can be performed by the individual elements. In particular, the side elements prevent the support element from rotating relative to the support rail, while the center element ensures that the musical instrument is securely and gently supported.

In a beneficial embodiment of the invention, the center element can be connected to an outer side surface through a positive connection to a side element so that it cannot rotate, particularly by means of suitably formed, preferably stepped, edge profiles. The edge profiles are preferably designed, at least in sections, circumferentially along the perimeters of the center element or the side element around the longitudinal axis of the support rail. One or both side elements can be designed to be attachable to the center element. The side elements preferably have a, particularly isosceles, (rounded) basic triangular shape, which is adapted in particular in the area of a corner (angular) to the mounting recess. A positive connection secured against rotation between the center element and a side element has the benefit that the center element itself does not have to have a mounting recess matching the cross-section shape of the support rail. In particular, the center element can be designed in this way as a hollow body, through which its form elasticity or softness can be increased.

In a beneficial embodiment of the invention, the center element comprises a hollow body open on both sides in the longitudinal direction, wherein—in one central area of the hollow body on an outer side—the support surface and—in at least one lateral area of the hollow body—a, preferably crescent-shaped, support edge protruding towards the support surface forms the lateral support surfaces.

In particular, the hollow body forms a passage opening for feeding the support rail through in the longitudinal direction. In particular, the support edge forms the lateral support surfaces on an inner side surface aligned towards the central area of the hollow body. The support surface preferably passes continuously into the lateral support surfaces. In particular, the hollow body on an outer side forms a (in a non-deformed state of the center element, i.e. without a supported musical instrument) flat support surface with inward curved (concave) lateral support surfaces connecting it thereto laterally. In particular, the hollow body has a narrower (elongated) cross-section with respect to the lateral areas, wherein the cross-section (constantly) expands towards the edges or towards the edge profile in the lateral areas, wherein the edge cross-section of the hollow body preferably aligns itself to the (triangular) edge cross-section of the side elements. A center element designed as a hollow body can be easily and economically manufactured and can have a high elasticity or softness. Thus, the support element can sit well on the contour of the body of the musical instrument.

In an alternative embodiment of the invention, the support element has an inner support element, which forms the mounting recess, and an outer, preferably one-piece, cover element that can be mounted, particularly attached, on the inner support element, which forms in particular the central support surface and the lateral support surfaces, wherein preferably the inner support element is designed to be bend-resistant and/or torsion-resistant and the cover element is designed to be soft and elastic. The cover element can have fasteners on its rear side for attaching it to the inner support element, which is particularly adapted to the shape of the inner support element. In particular, the inner support element can be mounted in a first support arrangement and in a second support arrangement set by being rotated relative to the support rail, particularly capable of being pushed onto a support rail in the longitudinal direction or clamped onto a support rail in the transverse direction. The cover element is preferably fully made from a thermoplastic elastomer (TPE).

The object is also particularly achieved through a support element, which is designed for fastening on a support rail with a non-rotationally symmetrical cross-section shape of a musical instrument according to the invention.

The object is also particularly achieved through a musical instrument stand, particularly a multiple guitar stand, for holding at least one musical instrument having a body and a neck, particularly at least one guitar and/or bass guitar, particularly through by means of a musical instrument stand according to the invention described above, wherein the musical instrument stand comprises a rack and preferably at least one pair of support elements capable on being mounted on the rack having respectively one support surface for the body of the musical instrument, wherein the rack has a support frame with two support rails running parallel to each other having respectively a non-rotationally symmetrical, especially polygonal, cross-section shape and a, preferably pivoting, contact bracket connected to the support frame, wherein the contact bracket has a contact rail running parallel to the support rails and at least one support arm connecting the contact rail respectively to the support frames, wherein the contact rail defines at least one contact surface for the neck of the musical instrument directly or via contact elements capable of being fastened on the contact rail, wherein the at least one support arm has a telescopic design with respectively one outer support arm profile and an inner support arm profile that is received therein so that it can move.

The outer support arm profile can be made from a different material than the inner support arm profile. The outer support arm profile is preferably made from an aluminum tube, while the inner support arm profile is a plastic injection-molded part, preferably consisting of fiber-reinforced plastic, e.g. polyamide. On one hand, a telescopic musical instrument stand has the advantage that the contact rail can be positioned at any height, for example, in relation to the length of the necks of the musical instruments to be retained. Thus, flexibility during use and adaptability for different musical instruments is further increased. On the other hand, a telescopic support arm enables a smaller assembled size or packing size of the musical instrument stand, for example when not in use or for transportation.

In a beneficial embodiment of the invention, the support arm has a locking mechanism, particularly between the outer and inner support arm profile in order to set the contact rail in a specific telescoped position. A latching mechanism, preferably having an operable locking button, can be provisioned as a locking mechanism in a section will the outer support arm profile overlaps with the inner support arm profile.

The object is also achieved in particular through a musical instrument stand, particularly a multiple guitar stand, for holding at least one musical instrument having a body and a neck, particularly at least one guitar and/or bass guitar, particularly through a musical instrument stand according to the invention described above, wherein the musical instrument stand comprises a rack and preferably at least one pair of support elements capable of being mounted on the rack with respectively one support surface for the body of the musical instrument, wherein the rack has a support frame with two support rails running parallel to each other having a respectively non-rotationally symmetrical, especially polygonal, cross-section shape and a contact bracket connected to the support frame, wherein the contact bracket has a contact rail running parallel to the support rails and at least one support arm, connecting the contact rail respectively to the support frames, wherein the contact rail defines at least one contact surface for the neck of the musical instrument directly or through contact elements capable of being mounted on the contact rail, wherein the support frame is connected to the contact bracket by at least one swivel joint so that it can pivot, wherein the contact bracket has a first engagement device and is capable of being set in at least an end position by means of a locking mechanism, preferably in both end positions.

A pivoting contact bracket has the advantage that the position of the contact bracket is variable, for example in order to set the inclination angle of the contact bracket with respect to the support frame for certain musical instruments. Thus, the musical instrument stand can be used more flexibly. The contact bracket can be secured against unintentional swiveling (collapsing) by locking the contact bracket in an end position. Thus, damage to the rested musical instrument and/or unintentional swiveling of the contact bracket, e.g. during transport, can be prevented.

In a beneficial embodiment of the invention, the locking mechanism comprises a bending element firmly connected to the support frame, preferably a plastic spring element molded onto the support frame, which has a degree of bending freedom vertically to the pivot axis of the swivel joint and a second engagement device corresponding to the first engagement device and a spring supported on the support frame, preferably consisting of metal, which impinges the bending element in the direction of the pivot axis with engagement spring tension. This locking mechanism is constructively simple to execute. The spring can be inserted preferably from the bottom into a receiving opening of a crossbar of the support frame. The use of a metal spring has the advantage that the locking mechanism can be impinged with sufficiently large engagement spring tension.

In a beneficial embodiment of the invention, the spring has two pairs of contact tongues and a crossbar connecting the pairs of contact tongues, wherein the pair of contact tongues rest on the support frame and the crossbars engage into a groove of the bending element. The spring is particularly designed as a bent wire clip, e.g. consisting of steel with a diameter of approx. 3 mm. In this manner, the spring can impinge the bending element with a sufficiently large engagement spring tension.

In a beneficial embodiment of the invention, contact tongue ends of the spring engages in a circumferential groove of the axis of the swivel joint, particularly in order to axially secure the axis or the axle pin. The contact tongue ends are formed particularly through straight contact sections of the spring. In this way, the spring can also perform the function of securing the axis for pre-tensioning the bending element.

Although, contrary to the state of the art, it is not necessary according to the invention for the overall length of the support elements mounted on a support rail to be coordinated to the length of the side members in order to rotationally set the support elements due to the mounting recess of the support elements matched to the cross-section shape of the support rails, this can nevertheless be the case. On one hand, the lengths of various support elements capable of being mounted, or a set of support elements suitable for assembly having different lengths, can be coordinated to each other and to the length of the support rails in such a way that a number of different configurations can be produced. On the other hand, filling elements can be provisioned, which are pushed in or attached between two adjacent support elements, in order to prevent the support elements from shifting axially to each other when assembled. For example, support elements having lengths of 120 mm or 180 mm and filling elements having lengths of 30 mm could be provisioned in order to be assembled in various configurations on a support rail having an assembled length (length of the support rail between two crossbars) of 420 mm, 660 mm or 900 mm.

BRIEF DESCRIPTION OF THE DRAWINGS

Examples of embodiments of the invention are explained in further detail below based on the drawings, which are respectively schematic diagrams. The following are shown here.

DETAILED DESCRIPTION OF THE INVENTION

In the following, description of the invention, the same reference signs are used for identical and identically functioning elements.

FIGS. 1 to 4 respectively show embodiments of a musical instrument stand 1 respectively having three (FIG. 1), four (FIGS. 2 and 3) or only one (FIG. 4) pair of support elements 20*a*, 20*b* according to the invention with a respectively identical functionality.

Figure 1:
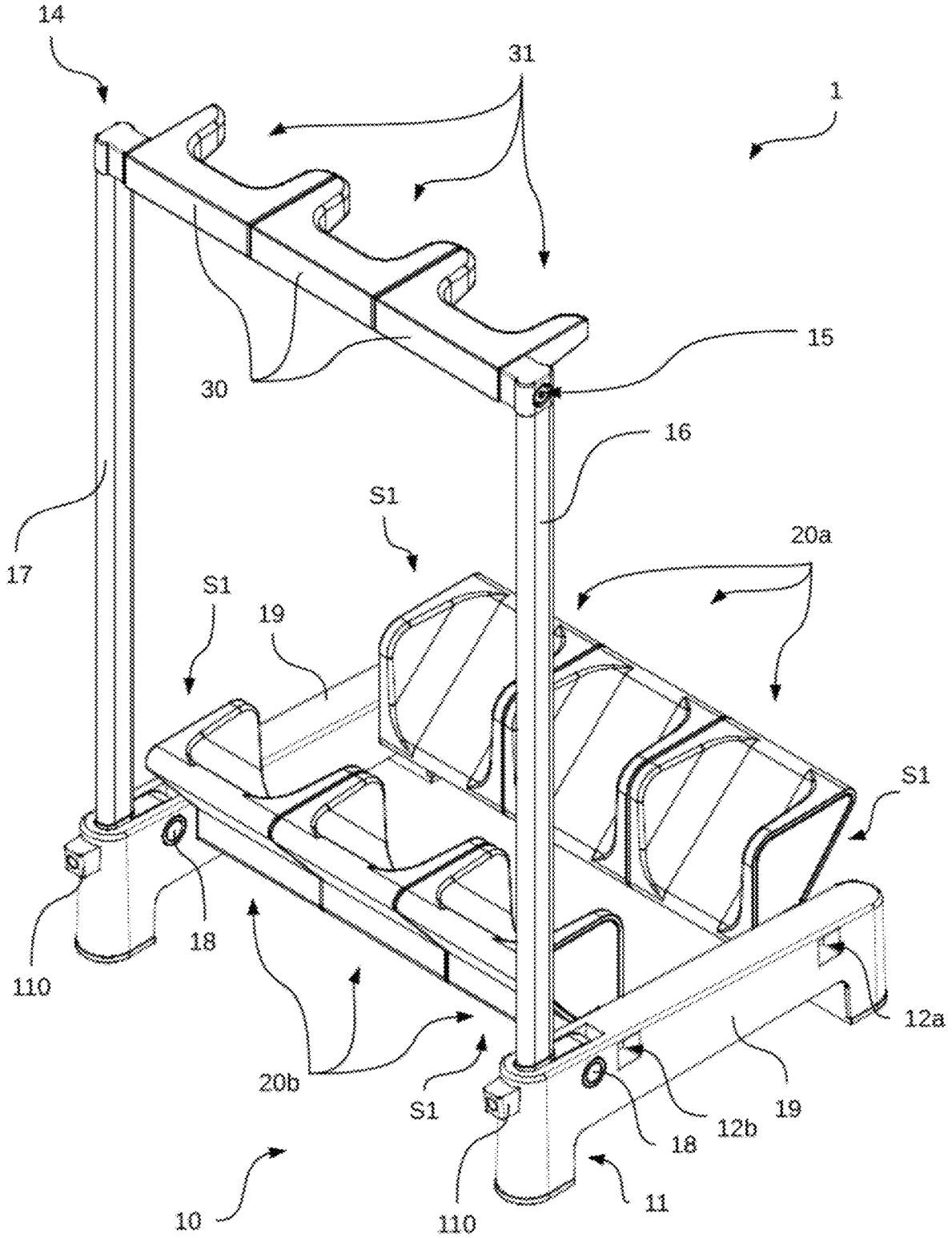
FIG. 1 is an embodiment of a musical instrument stand according to the invention with three pairs of support elements according to the invention in a perspective view.

Musical instrument stand 1 depicted in FIG. 1 consists of a rack 10 and a contact bracket 14 connected to it. Rack 10 has a support frame 11, which is formed by two parallel running support rails 12*a*, 12*b*, and crossbars 19 connecting support rails 12*a*, 12*b*. Support elements 20*a* or 20*b* are respectively pushed onto support rails 12*a*, 12*b* (see FIG. 4), wherein all three pairs of a total of six identical support elements 20*a*, 20*b* are mounted in a first support arrangement S1 on support rails 12*a* or 12*b* FIG. 1. Support elements 20*a*, 20*b* can have a one-piece or multi-piece design, particularly consisting of multiple materials. Thus, e.g. up to three similar guitars can be held in musical instrument stand 1. Support elements 20*a*, 20*b* have a shell-like design and serve to support the body of a musical instrument 2, for example an electric or acoustic guitar or a bass guitar. Mounted support elements 20*a*, 20*b* have the same length, wherein support elements 20*a*, 20*b* are capable of being independently mounted and are interchangeable. Support elements 20*a*, 20*b* of different lengths can be mounted. Contact bracket 14 is connected to support frame 11 via two swivel joints 18. Contact bracket 14 comprises two lateral support arms 16, 17, which are connected to a contact rail 15 running parallel to support rails 12*a*, 12*b* via connecting elements. Three contact elements 30 are pushed onto contact rail 15, which form contact surfaces 31 with lateral contact surfaces 32, 33 for resting the neck of a musical instrument 2 supported in a support element 20*a*, 20*b*. Oil a rear side, support frame 11 has base elements 10 in order to be able to set musical instrument stand 1 up in a folded position.

Figure 2:
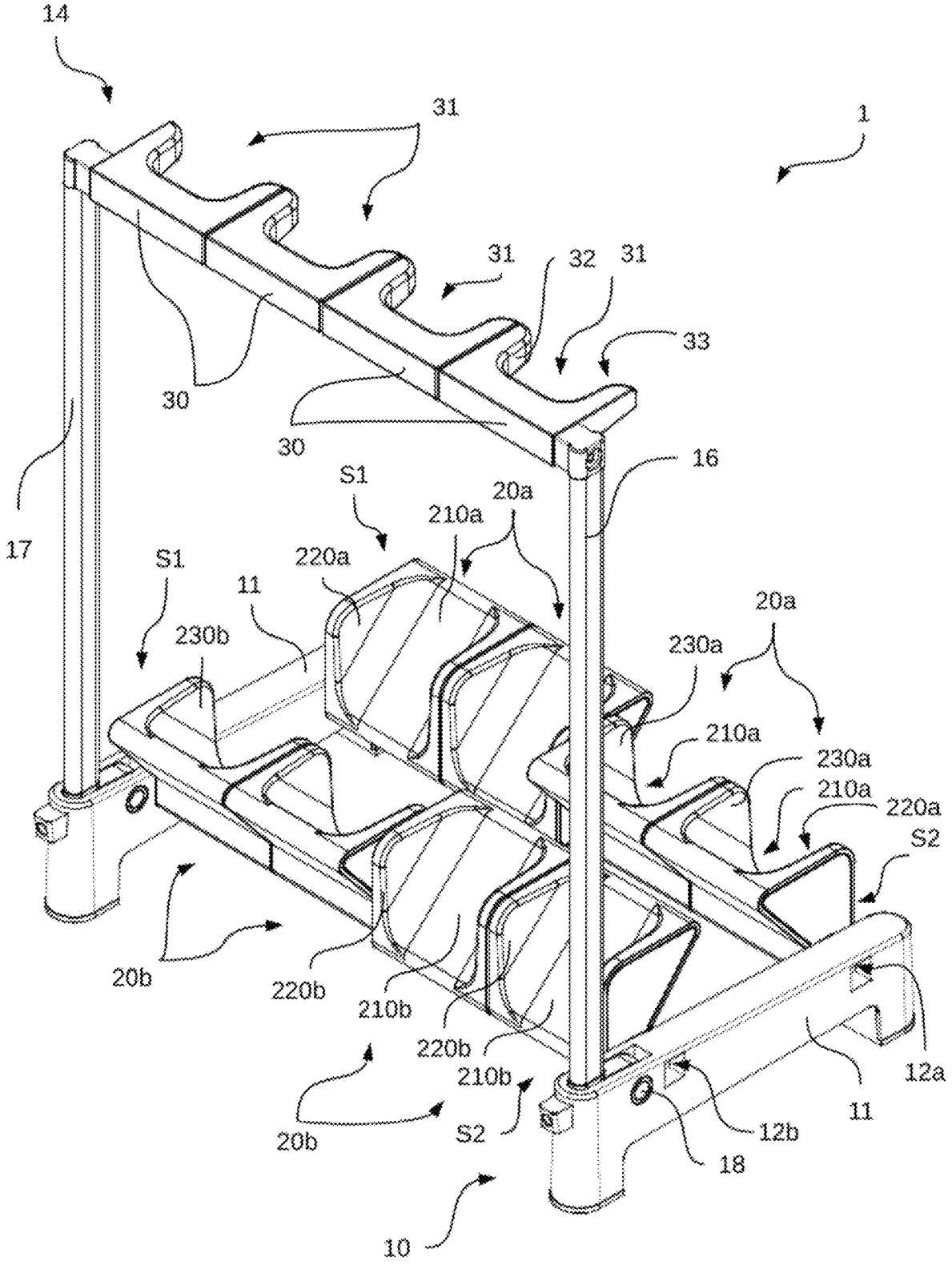
FIG. 2 is an embodiment of a musical instrument stand according to the invention with four pairs of support elements according to the invention of the same length in a perspective view.

The front two pairs of a total of four pairs of support elements 20*a*, 20*b* are mounted in a second support arrangement S2, while the rear two pairs are mounted in a first support arrangement S1 in the embodiment of musical instrument stand 1 depicted in FIG. 2. Support elements 20*a*, 20*b* can be switched back and forth by repositioning them between both support arrangements S1, S2. This can be done either by interchanging both support elements 20*a* and 20*b* of a pair, i.e. by mounting support elements 20*a* and 20*b* on respectively other support rail 12*b* or 12*a*, or through a reverse assembly of each support element 20*a*, 20*b* onto respective support rail 12*a* or 12*b*, i.e. by pushing on support element 20*a* or 20*b* that is rotated by 180°. All eight support elements 20*a*, 20*b* have the same length in FIG. 2.

Each support element 20*a*, 20*b* has a center support snake 210*a* or 210*b* and lateral support surfaces 220*a*, 220*b* or 230*a*, 230*b*. Support surfaces 210*a*, 210*b* run respectively diagonally to support rails 12*a* or 12*b* and, in doing so, define bearing planes E tilted towards each other (see FIGS. 5, 6, 7*a*, and 7*b*). Two support surfaces 210*a*, 210*b* are respectively aligned towards each other, i.e. in a V-shape, in first support arrangement S1. In a second support arrangement S2, support surfaces 210*a*, 210*b* are respectively aligned away from each other, i.e. in an A-shape. First support arrangement S1 is particularly suitable for supporting a guitar with a round body shape, while second support arrangement S2 is particularly suitable for supporting a guitar with a V-shaped body. Lateral support surfaces 220*a*, 220*b*, 230*a*, 230*b* are formed by support edges 27 that are formed by support elements 20*a*, 20*b*, which protrude with respect to bearing plane E or support surface 210*a*, 210*b*. Lateral support surfaces 220*a*, 220*b*, 230*a*, 230*b* prevent rested musical instruments 2 from being able to turn sideways in support elements 20*a*, 20*b*. Thus, musical instruments 2 are also unable to bump into each other and become damaged.

Figure 3:
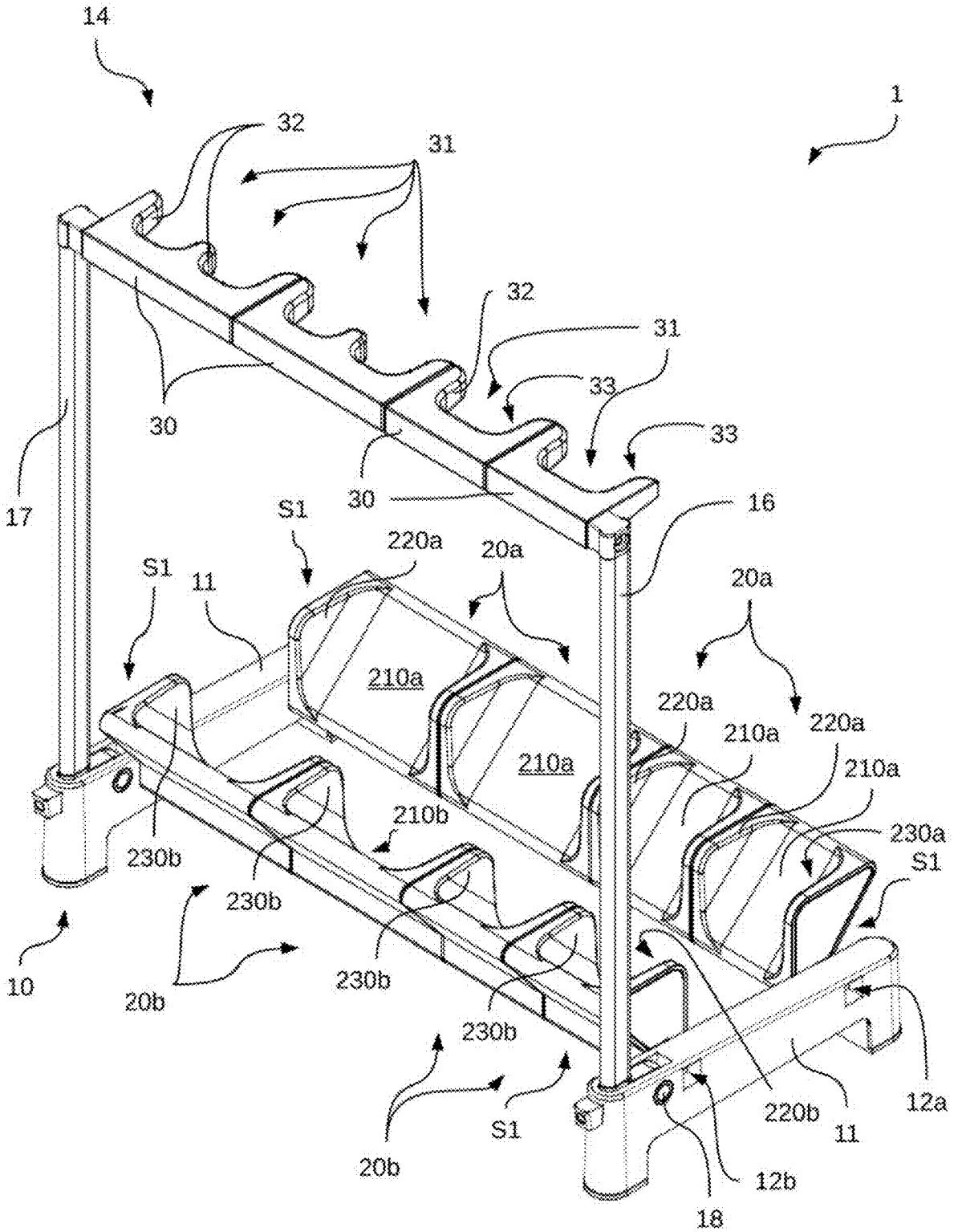
FIG. 3 is an embodiment of a musical instrument stand according to the invention with four pairs of support elements according to the invention of different length in a perspective view.

An embodiment corresponding to FIGS. 1 and 2 having a total of four pairs of support elements 20*a*, 20*b* is depicted in FIG. 3, wherein the from two pairs are shorter, e.g. 120 mm long, than both rear pairs, which are, e.g. 180 mm long. Shorter, or narrower, support elements 20*a*, 20*b* are particularly suitable for supporting electric guitars or bass guitars, while longer, or wider, support elements 20*a*, 20*b* are particularly suitable for acoustic guitars, which typically have a deeper, or wider, body. Both rear contact elements 30 are designed to match this with a double indentation having an intermediate center protrusion, which have suitable contact surfaces 31 and lateral contact surfaces 32, 33 for the neck of an acoustic guitar in respectively one of the two possible resting positions.

Figure 4:
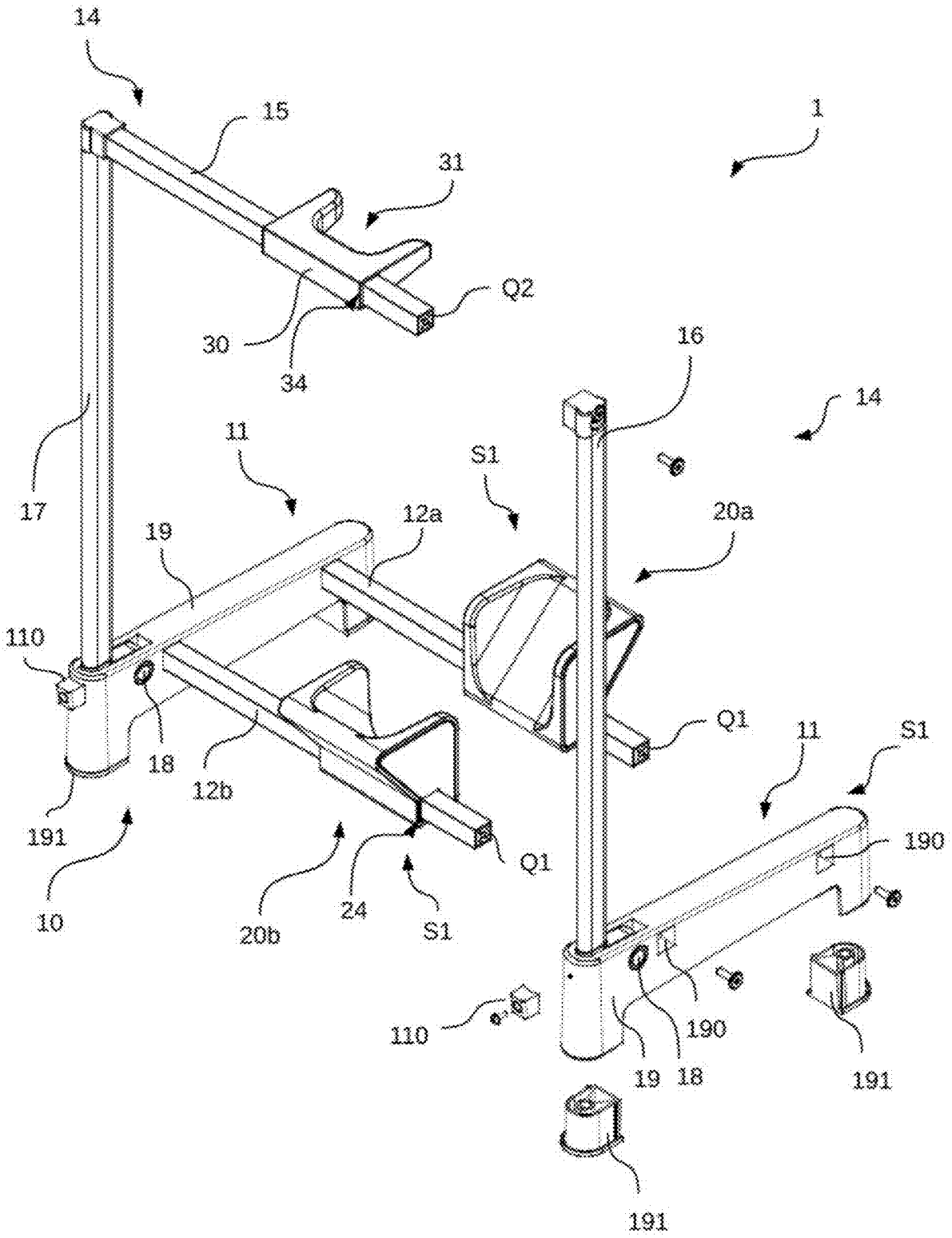
FIG. 4 is an embodiment of a musical instrument stand according to the invention in a perspective exploded view with one pair of support elements according to the invention of support elements according to the invention.

The assembly process or the adjustment of a musical instrument stand 1 can, be found in FIG. 4. Support rails 12*a*, 12*b* are designed as aluminum profiles having a non-rotationally symmetrical cross-section shape Q1—in this case, as square hollow profiles—which are inserted into passage openings 190 in crossbars 19 and fastened with screws on the front. Crossbars 19 are preferably made of a plastic, such polyamide, for example of PA6, although they could also consist of metal, e.g. aluminum. Stand elements 191 are inserted from the bottom and base elements 110 are screwed on from behind. Analogous to support rails 12*a*, 12*b*, contact rail 15 made of an aluminum profile having a square cross-section shape Q2 is screwed to support frames 16 and 17 via connecting elements. Support elements 20*a*, 20*b* and support elements 30 are pushed on in the longitudinal direction of support rails 12*a*, 12*b* or of contact rail 15. Alternatively, they can also be clamped onto support rails 12*a*, 12*b* from the top or laterally. For this purpose, support elements 20*a*, 20*b* and contact elements 30 have mounting recesses 24 or/and 30, which are matched to cross-section shape Q1 or Q2 or positively correspond to them. Support elements 20*a*, 20*b* and contact elements 30 can be mounted through mounting recesses 24 or 34 on support rails 12*a*, 12*b* or contact rail 15 in an orientation set by means of rotation such that they are secured from turning. Additional mounting elements can therefore be eliminated. FIG. 4 clearly illustrates that support elements 20*a*, 20*b* could be respectively inversely pushed onto support rails 12*a*, 12*b* or are interchangeable with each other in order to be positioned in either first support arrangement S1 or second support arrangement S2. This provides great flexibility when using the musical instrument stand, particularly adaptability for different types of musical instruments 2, especially guitars having round or V-shaped bodies.

Figure 5:
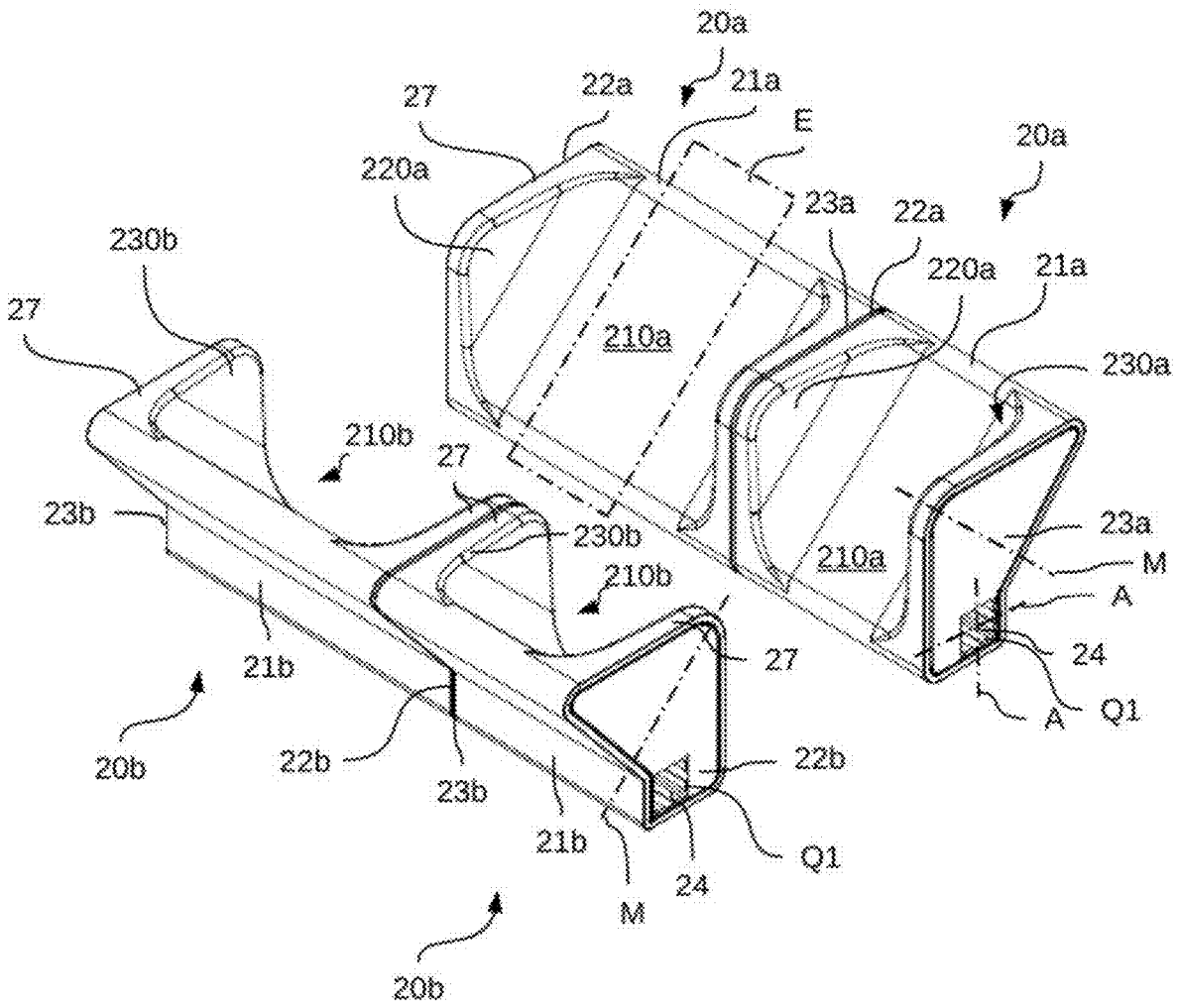
FIG. 5 is two embodiments of one of support elements according to the invention according to FIGS. 1 to 4 with a different length in a perspective view.
Figure 6:
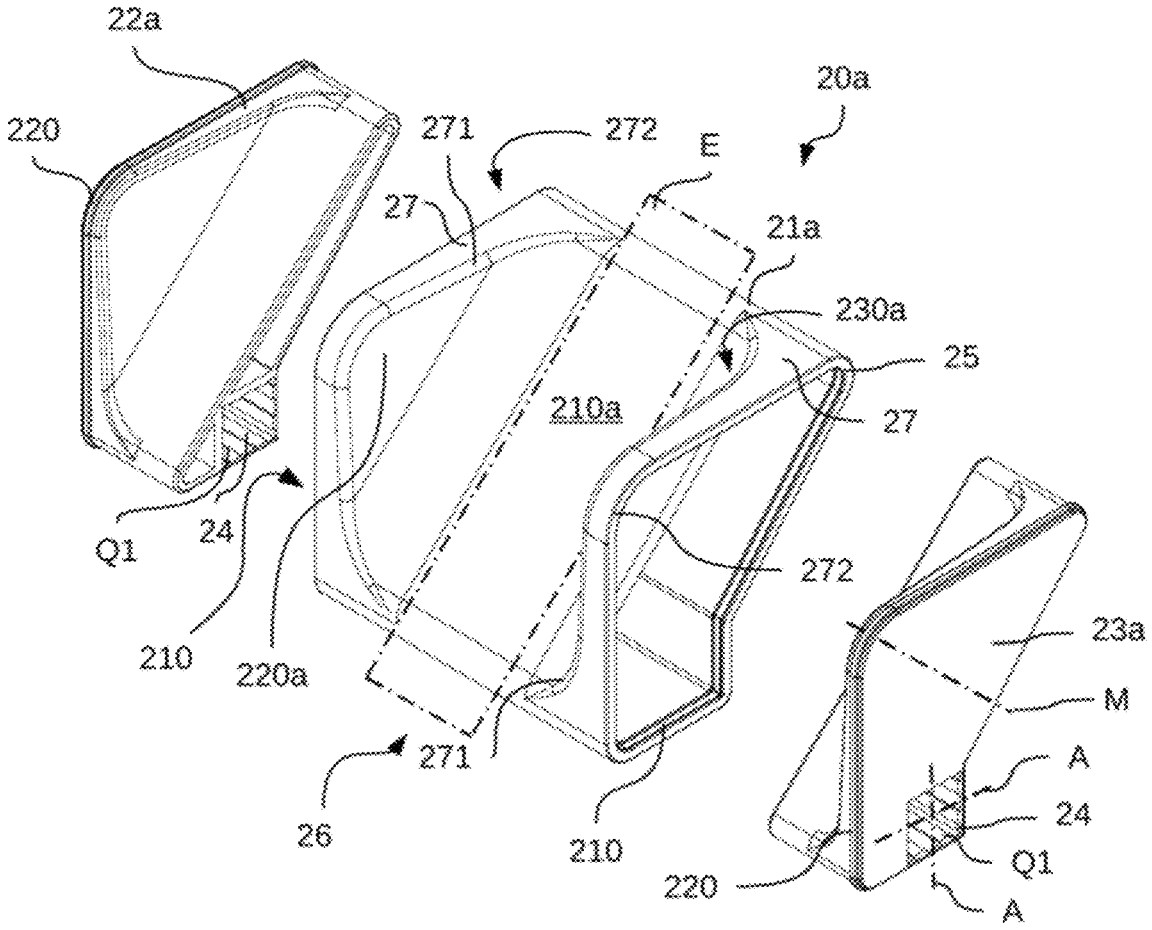
FIG. 6 is a schematic diagram of one pair of support elements according to the invention according to FIG. 5 in a perspective exploded view.

Embodiments of a support element 20*a* according to the invention is depicted in FIGS. 5 and 6, which would have to be respectively inversely depicted for a support element 20*b*, wherein two embodiments of a support element 20*a* are depicted in FIG. 5 with respectively different lengths. Support element 20*a* has a three-piece design with a center element 21*a* and two side elements 22*a*, 23*a*. Side elements 22*a*, 22*b* are made from a thermoplastic, such as polyamide, e.g. PA 6, so that they are bend-resistant and torsion-resistant, while center element 21*a* is made of a thermoplastic elastomer (TPE) that is soft and elastic. Thus, side elements 22*a*, 23*a* are made from a different material, which is particularly more rigid, than center element 21*a*. Side elements 22*a*, 23*a* respectively have a basic triangular form, wherein mounting recess 24 is designed with respect to a center axis M in the area of a lower corner. Mounting recess 24 is designed as a passage opening matched to cross-section shape Q1 of support rails 12*a*, 12*b* and enables side elements 22*a*, 22*b* to be positively mounted on a support rail 12*a*, 12*b* so that they are secured against rotation. Center element 21*a* is designed as a hollow body 25, wherein support surface 210*a* or diagonal support surface E defined by this is designed on an outer side 26. Support surface 210*a* passes laterally to side support surfaces 220*a* or 230*b*, which are designed through inner side surfaces 272 of crescent-shaped support edges 27. Side elements 22*a*, 23*b* can be attached laterally to or inserted into center element 21*a*, wherein a positive connection between both side elements 22*a*, 23*a* and center element 21*a* that is secured against rotation is achieved by surrounding stepped edge profiles 210 or 220. Bearing plane E is rotated by 45° with respect to symmetrical axes A of mounting recess 24 or cross-section shape Q1. Thus, bearing planes E run rotated towards each other in first and second support arrangement S1 or S2 (see FIGS. 7*a* and 7*b*).

Figure 7A:
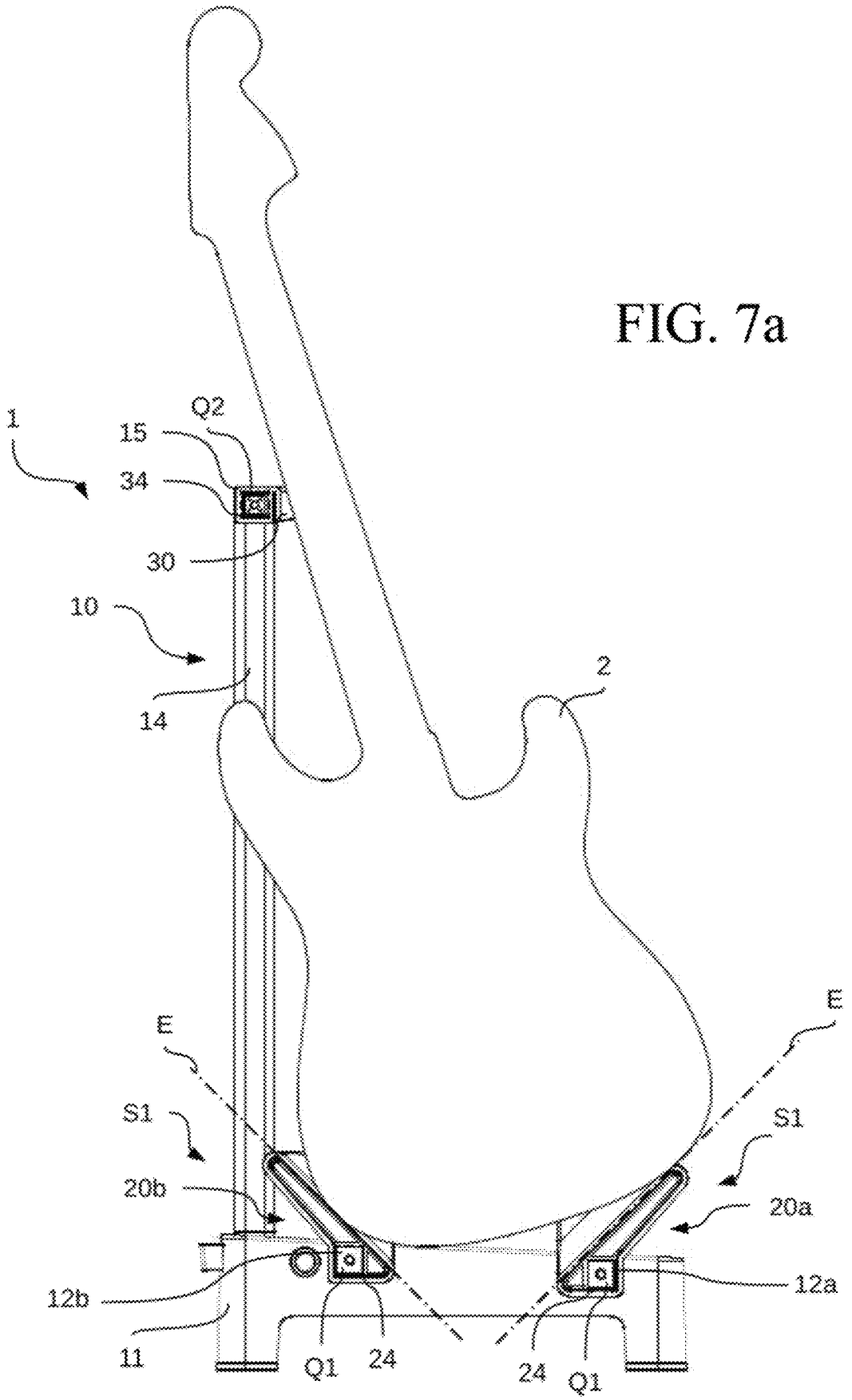
FIG. 7*a* is a musical instrument stand according to FIGS. 1 to 4 in a side view with support elements in a first support arrangement with a first musical instrument.
Figure 7B:
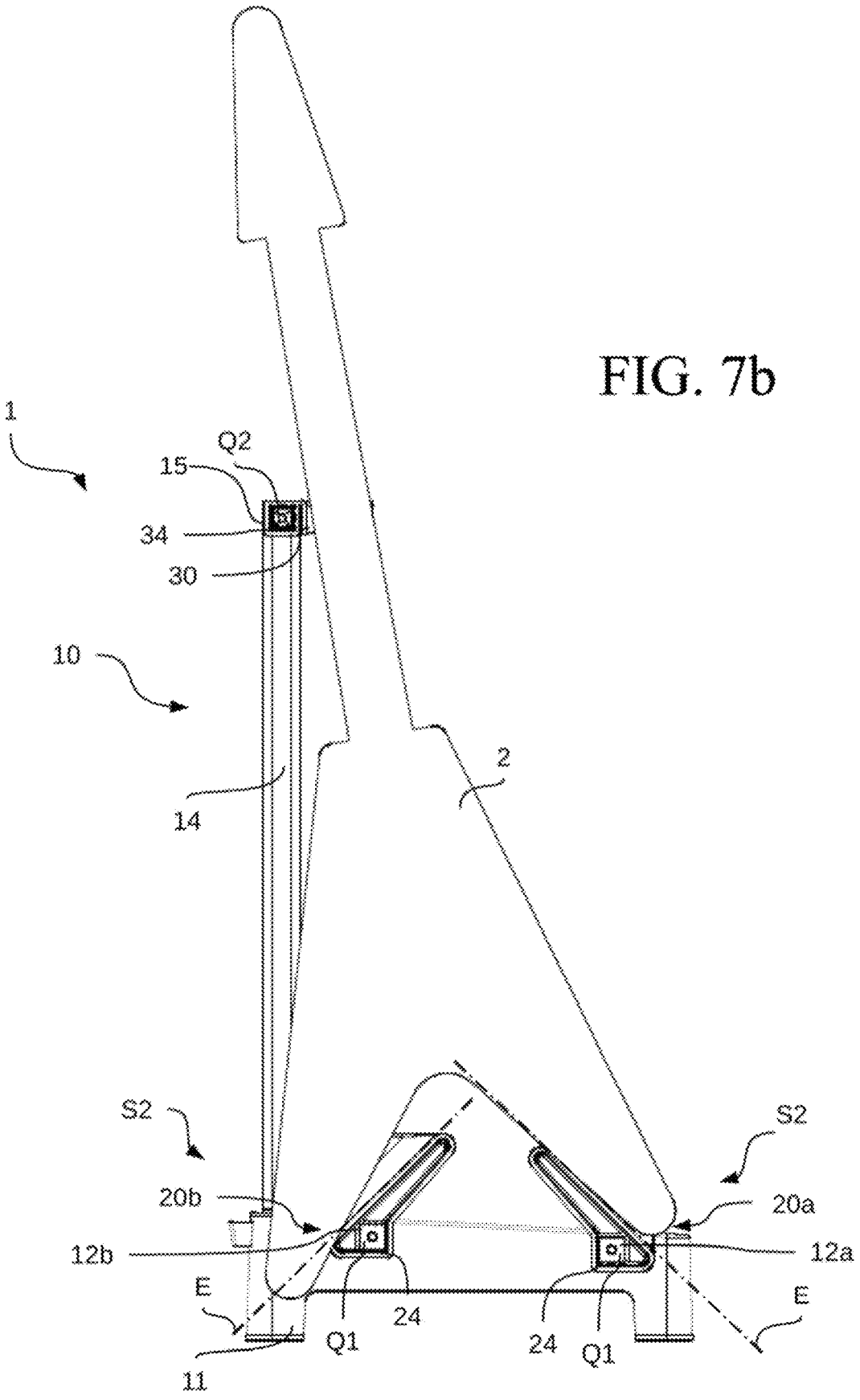
FIG. 7*b* is a musical instrument stand according to FIG. 7*a* with support elements in a second support arrangement with a second musical instrument.

A musical instrument stand 1 with a musical instrument 2 rested therein is depicted in FIGS. 7*a* and 7*b*. In FIG. 7*a*, a guitar having a round body is supported by support elements 20*a*, 20*b* mounted in first support arrangement S1 and leaned against contact element 30, while in FIG. 7*b* a guitar having a V-shaped body is supported by identical support elements 20*a*, 20*b* mounted in second support arrangement S2.

Figure 8A:
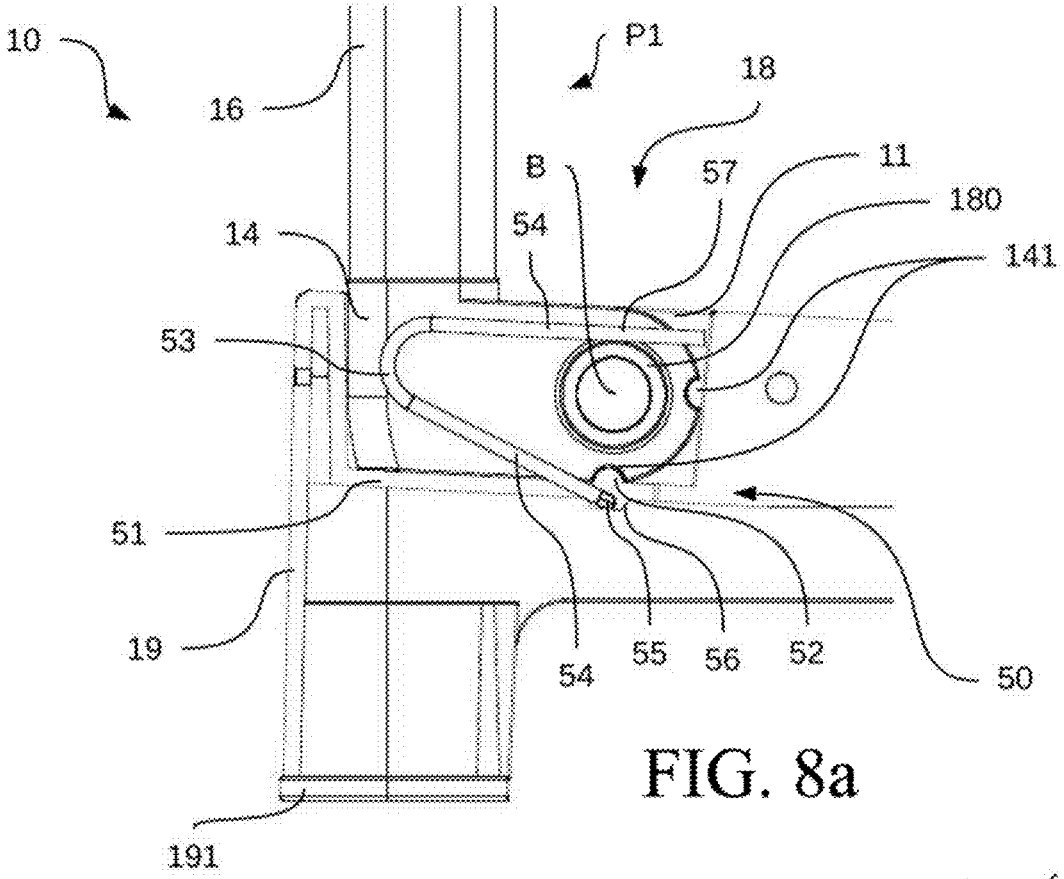
FIG. 8*a* is a swivel joint of an embodiment of a musical instrument stand according to the invention with a first end position of the contact bracket in a side view.
Figure 8B:
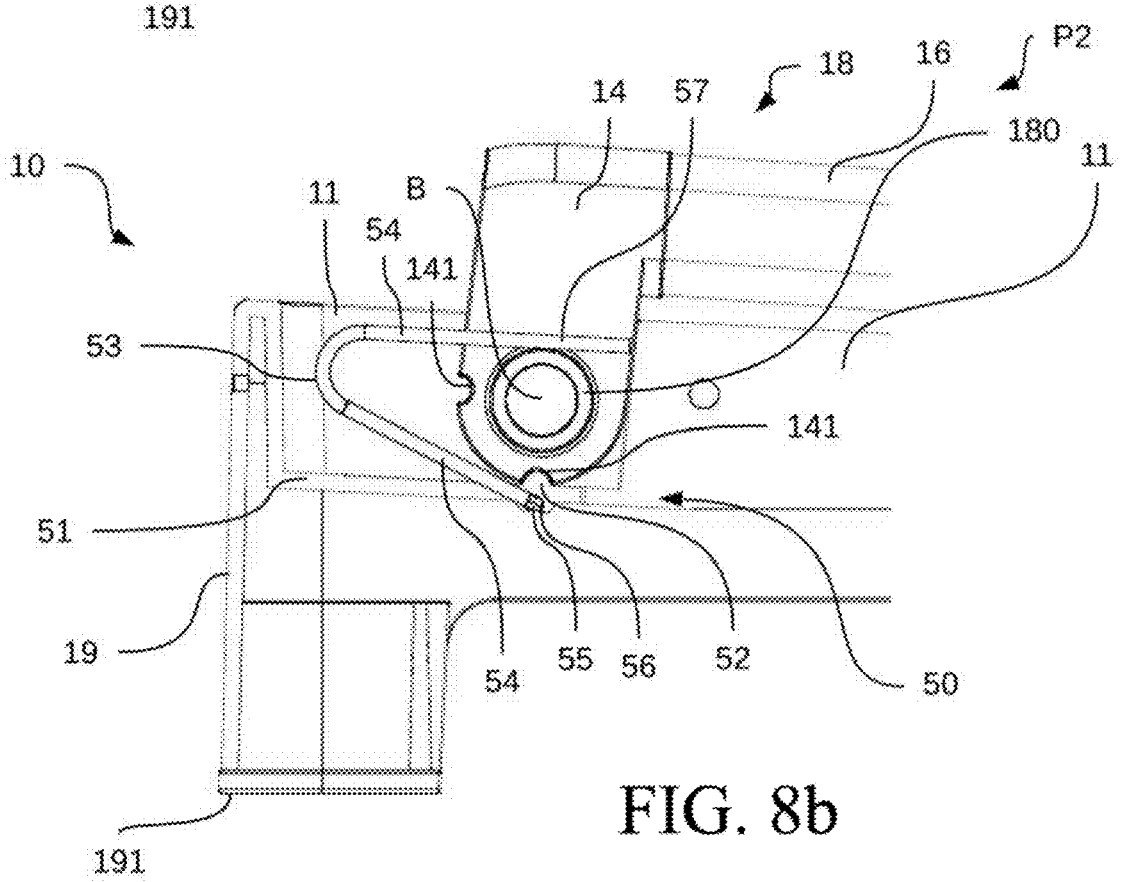
FIG. 8*b* is a swivel joint according to FIG. 8*a* with a second end position of the contact bracket in a side view.
Figure 9:
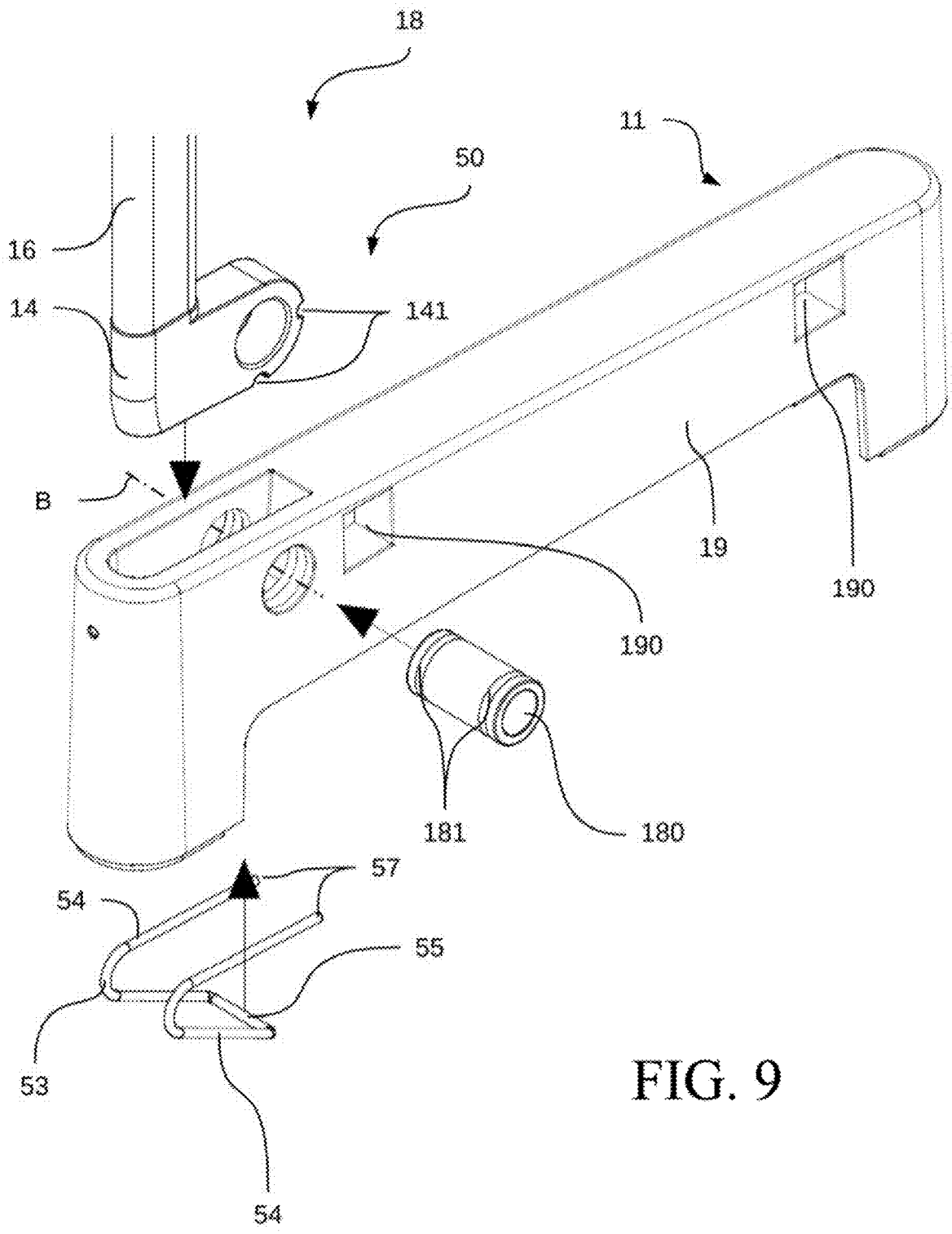
FIG. 9 is a swivel joint according to FIGS. 8*a* and 8*b* in a perspective exploded view.
Figure 10:
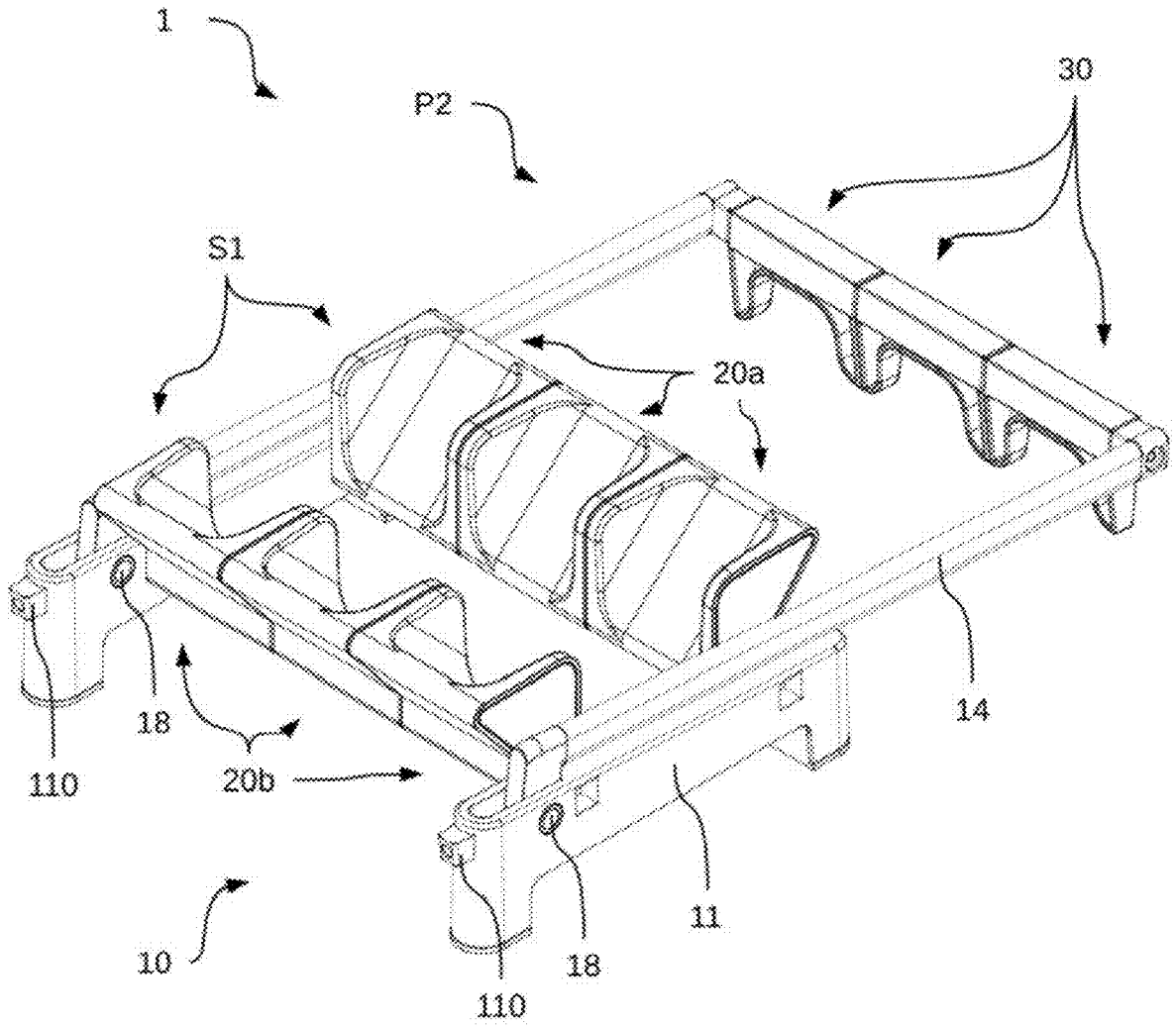
FIG. 10 is a musical instrument stand according to FIG. 1 with pivoted contact bracket.

A swivel joint 18 of rack 10 of a musical instrument stand 1 is depicted in FIGS. 8*a* and 8*b*, wherein swivel joint 18 is equipped with a locking mechanism 50. A joint head of contact bracket 14, which is made for example from a fiber-reinforced plastic and connected to support arm 16 or 17, has a first engagement device 141 in the form of two locking grooves designed along the peripheral contour. In first end position P1 of contact bracket 14 (FIG. 8*a*), support arm 16 is pivoted in a vertical direction, i.e. folded out. In second end position P2 of contact bracket 14, support arm 16 is pivoted in an essentially horizontal direction, i.e. collapsed or folded, and runs essentially parallel to crossbar 19. A bending element 51 is connected to support frame 11, which is cast on as a plastic bending element on an inner side of support frame 11 and has a degree of bending freedom in the direction of pivot axis B (from the bottom upwards in FIGS. 8*a* and 8*b*). Bending element 51 has a second engagement device 53 in the form of a locking tab designed to fit first engagement device 141, which respectively engages in another of both first engagement devices 141 in first or second end positions P1 or P2 in order to lock contact bracket 14 in the respective position. A spring 53 supported on an inner side of support frame 11 engages on the bottom of bending element 51 and in a groove 56 and impinges second engagement device 53 with a locking spring tension in the direction of first engagement device 141. Spring 53 is designed as a wire clip, for example with a diameter of 3 mm, having two pairs of contact tongues 54 and a crossbar 55 connecting both pairs of contact tongues 54, which snaps into groove 56 of bending element 51. Axis 180 of swivel joint 18 is inserted laterally in axis openings of support frame 11, wherein contact tongue ends 57 engage in a circumferential groove 181 of hollow axis 180 in order to secure it axially from slipping out. The assembly process of swivel joint 18 with locking mechanism 50 is depicted through arrows in FIG. 9, wherein spring 53 is first inserted into a mounting opening of crossbar 19 and contact bracket 14 from the top and then axis 180 is pushed in laterally. Spring 53 and thus bending element 51 is pre-tensioned in an installed state by bending contact tongue pairs 54 slightly upwards. A musical instrument stand 1 is depicted in FIG. 10 with contact bracket locked in second end position P2. In position P2, musical instrument stand 1 can, for example, be transported practically, folded up to save space and set up particularly on base elements 110. In addition, two or four floor rollers on rack 10 can be provisioned for pulling or pushing musical instrument stand 1.

Figure 11:
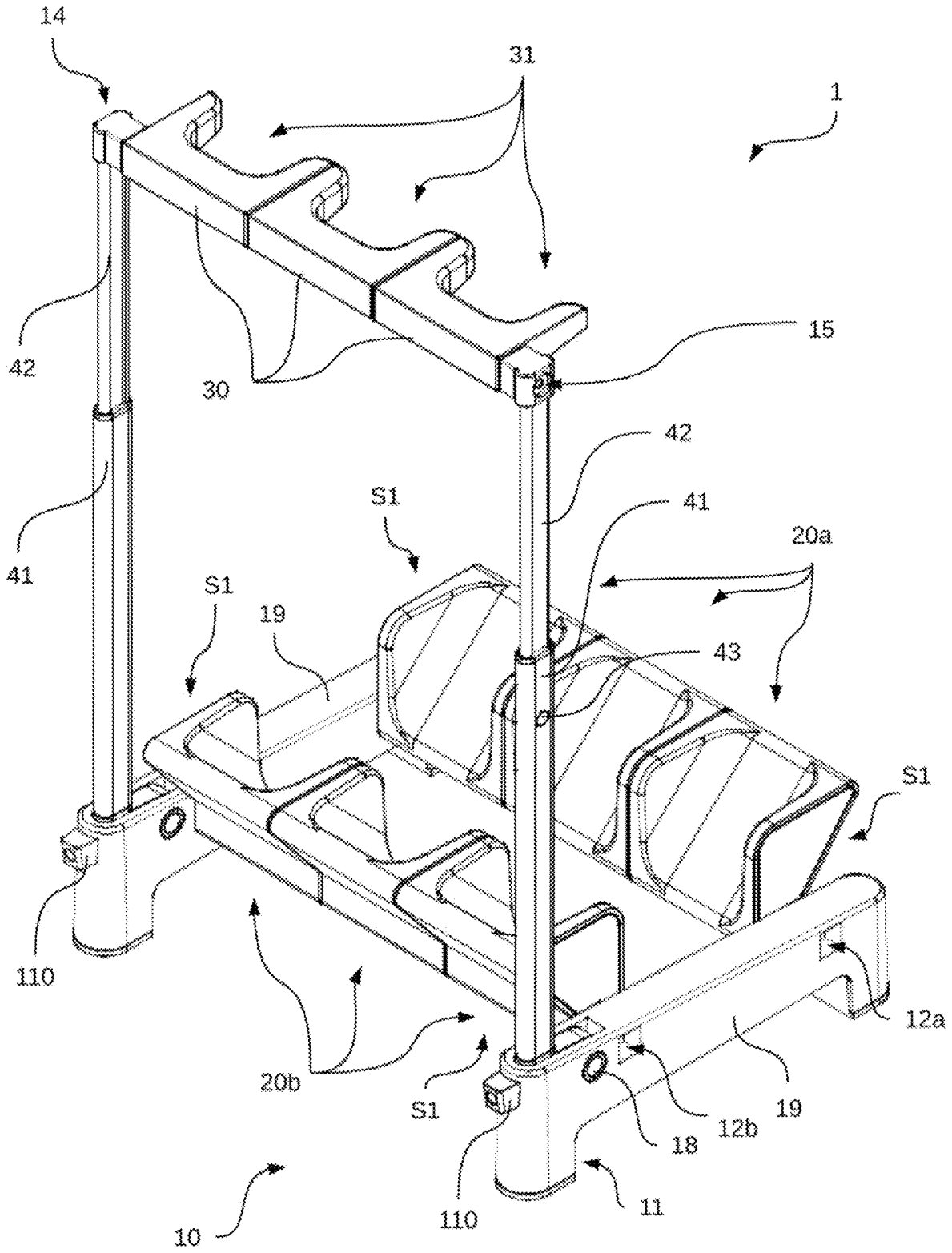
FIG. 11 is an embodiment of a musical instrument stand according to the invention with three pairs of support elements according to the invention and telescopic support arms in a perspective view.
Figure 12:
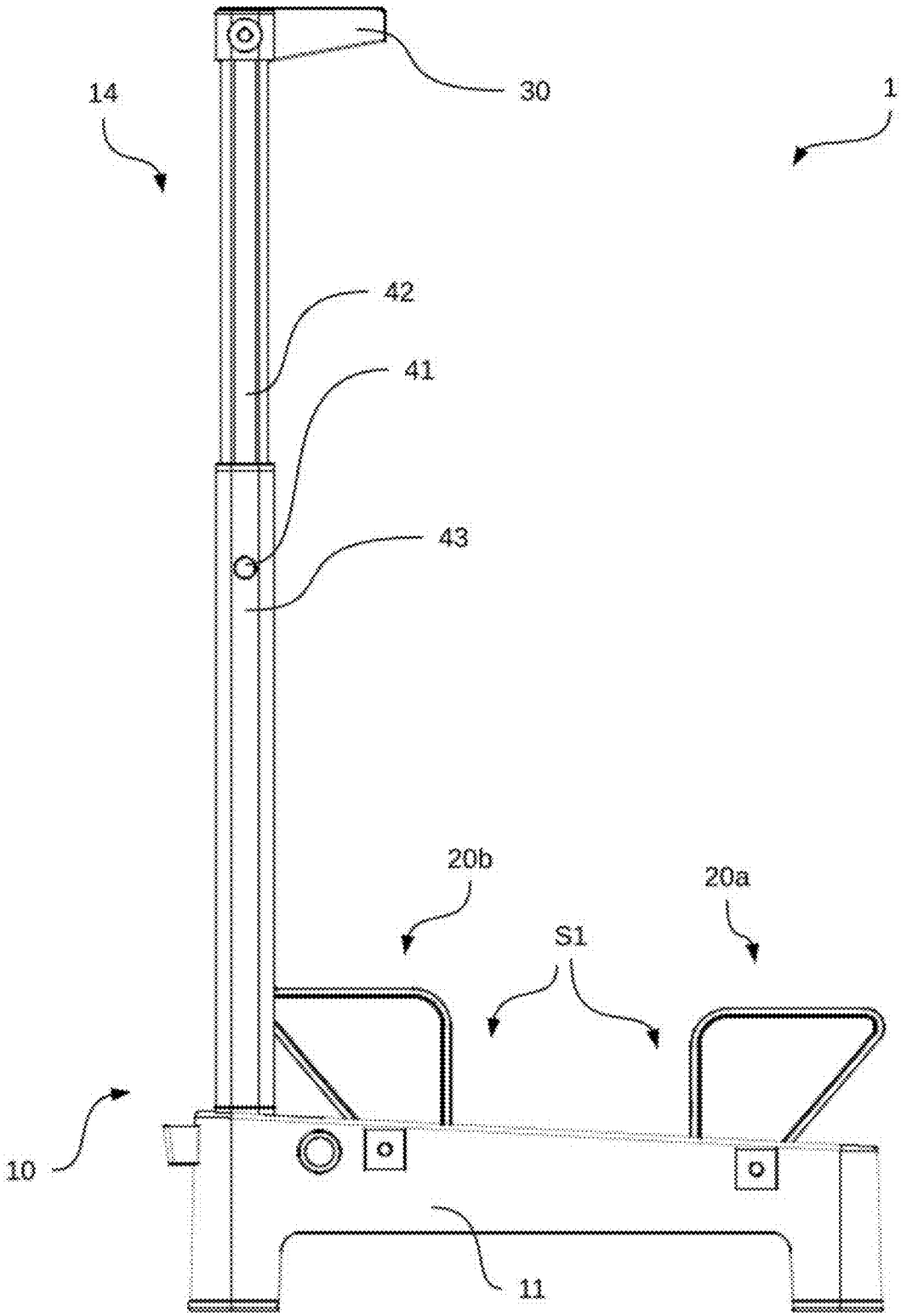
FIG. 12 is a musical instrument stand according to FIG. 11 in a side view.
Figure 13:
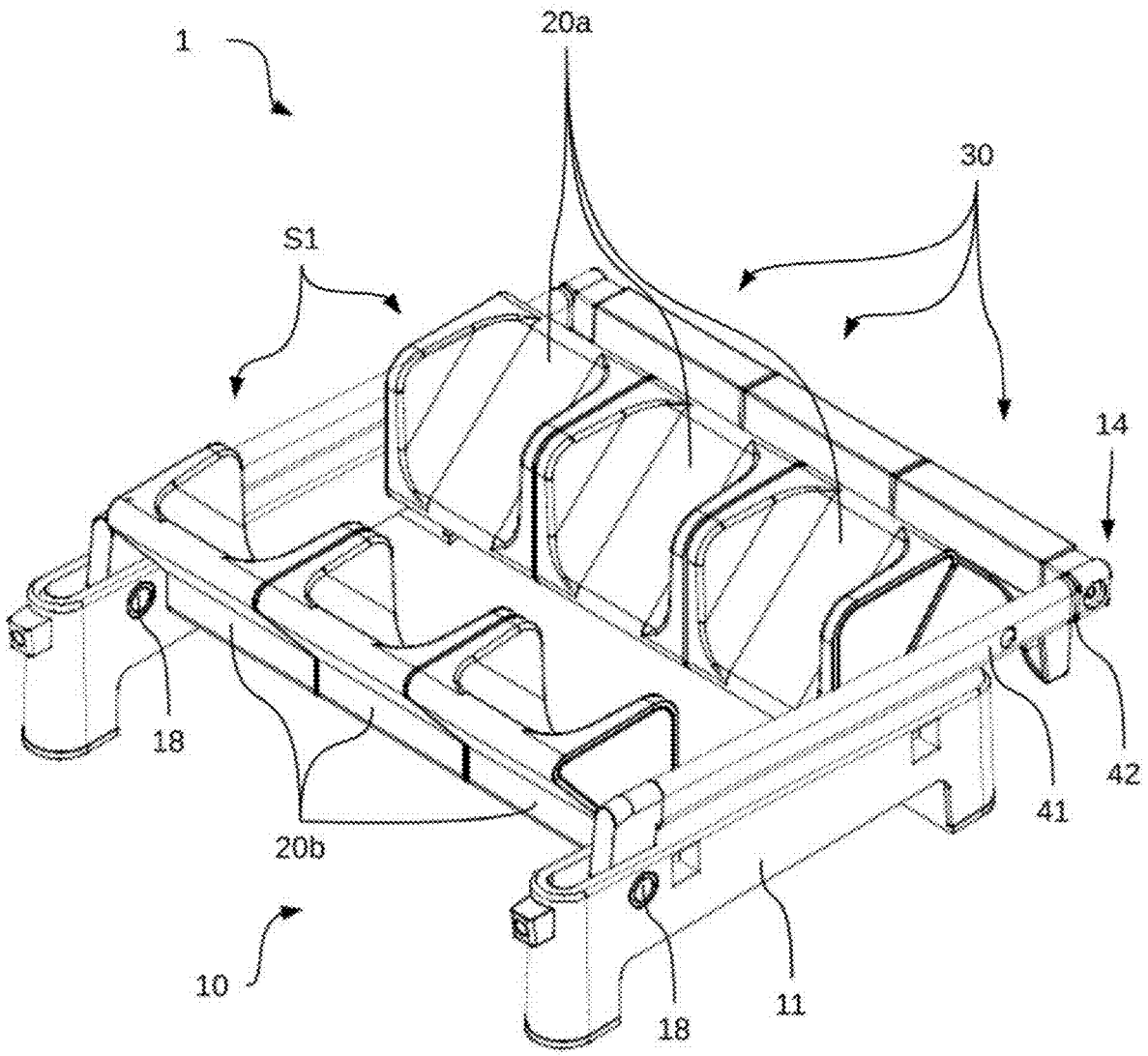
FIG. 13 is a musical instrument stand according to FIG. 11 with pivoted contact bracket.

An embodiment of musical instrument stand 1 is depicted in FIGS. 11, 12, and 13 with telescopic support arms 16, 17. Support arms 16, 17 comprise respectively one out support arm profile 41 and one inner support arm profile 42, which are arranged so that they can slide in each other and be set relative to each other in a telescoped or collapsed position via locking mechanisms 41. A telescoped position is depicted in FIG. 11. Telescopic support arms 16, 17 enable a smaller upright dimension or packing size of musical instrument stand 1, as is seen in the comparison of FIGS. 10 and 13. For example, the overall length of support arms 16, 17 can be shortened by approx. 20 to 35 cm when musical instrument stand 1 is folded up.

Figure 14A:
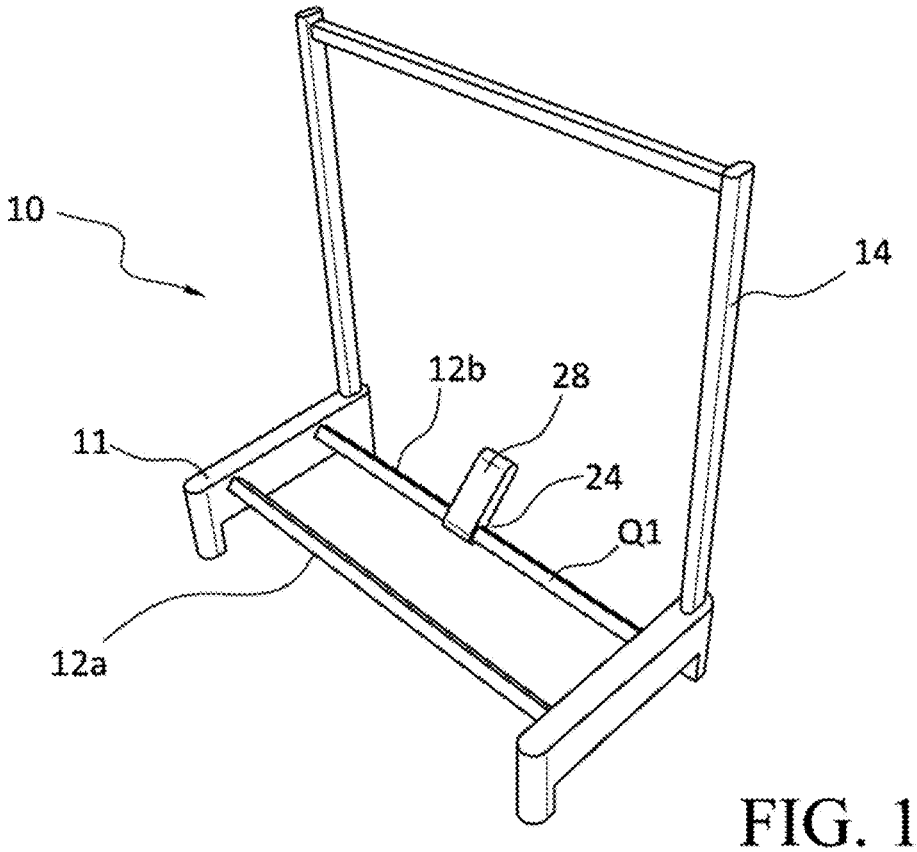
FIG. 14*a* is a rack of an embodiment of a musical instrument stand according to the invention with an inner bearing element of a support element according to the invention in a perspective view.
Figure 14B:
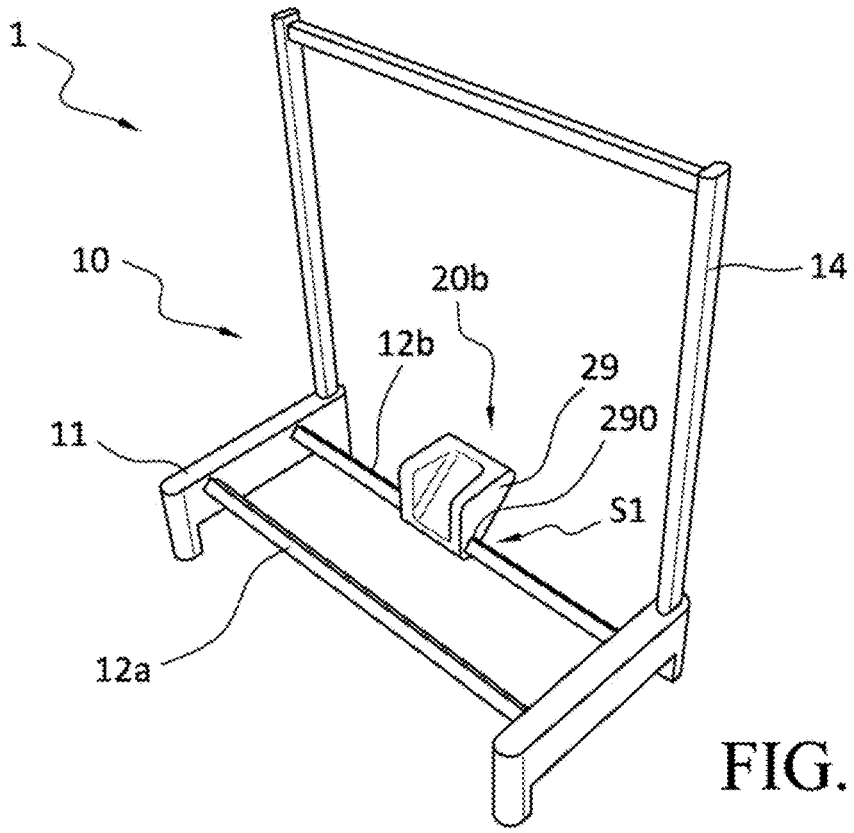
FIG. 14*b* is the musical instrument stand according to FIG. 14*a* with a support element according to the invention with an outer cover element.

An alternative embodiment of a support element 20*a* or 20*b* is depicted in FIGS. 14*a* and 14*b*, which has an inner support element 28 designed to be bend and torsion-resistant with a mounting recess 24 matched to cross-section shape Q1 of support rail 12*a*, 12*b*. Inner support element 28 can be assembled in various supporting arrangements S1 and S2 on support rails 12*a* or 12*b*, as previously described in conjunction with FIGS. 1 to 4. A preferably soft elastic cover element 29 designed as one-piece can be positively attached or placed on inner support element 28, preferably on both sides, in order to support a musical instrument 2. Fasteners are provisioned on the back of cover element 29, which are adapted to inner support element 28. Cover element 29 has a lateral rail recess 290 to enable support rail 12*a*, 12*b* to be ted through in the assembled state.

Figure 15:
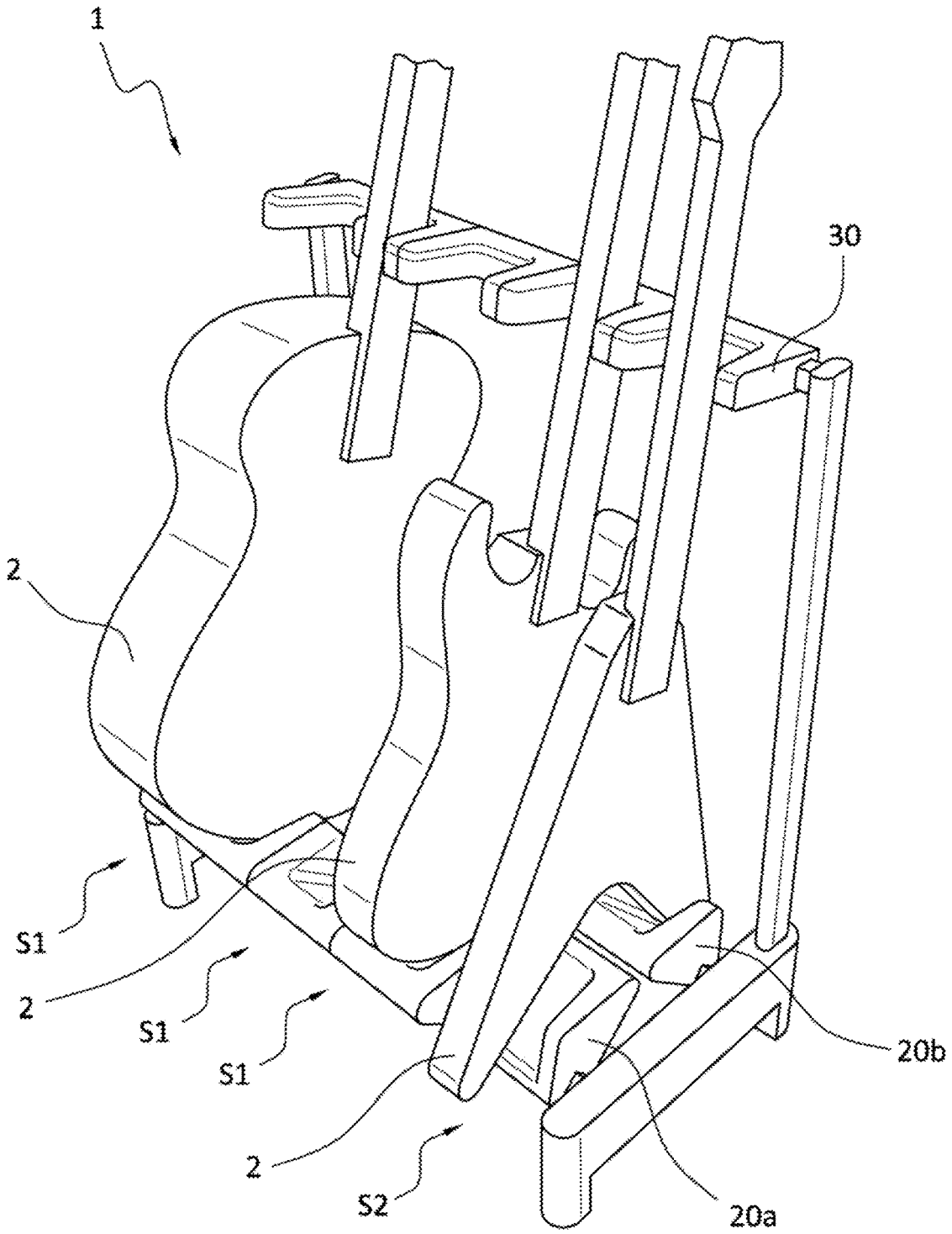
FIG. 15 is an embodiment of a musical instrument stand according to the invention with three different musical instruments in a perspective view.

A musical instrument stand 1 is depicted in FIG. 15 with four pairs of support elements 20*a*, 20*b* of a varying, length, which are assembled in two different support arrangements S1 and S2 in order to receive a total of three different types of musical instruments 2.

Figure 16A:
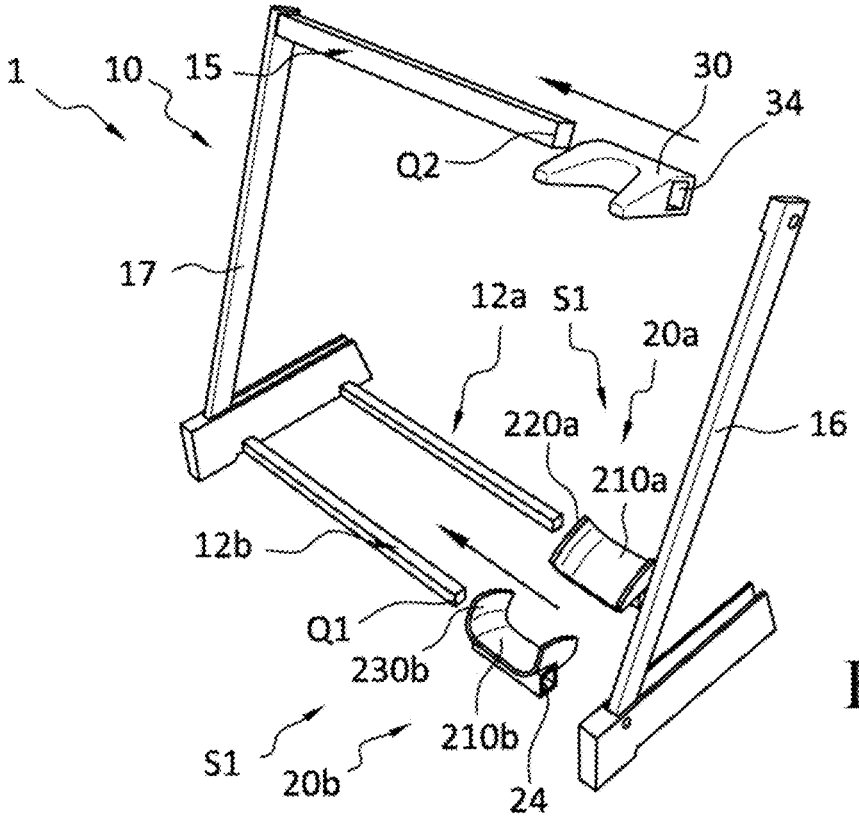
FIG. 16*a* is an embodiment of a musical instrument stand according to the invention with one pair of support elements according to the invention in a perspective exploded view.
Figure 16B:
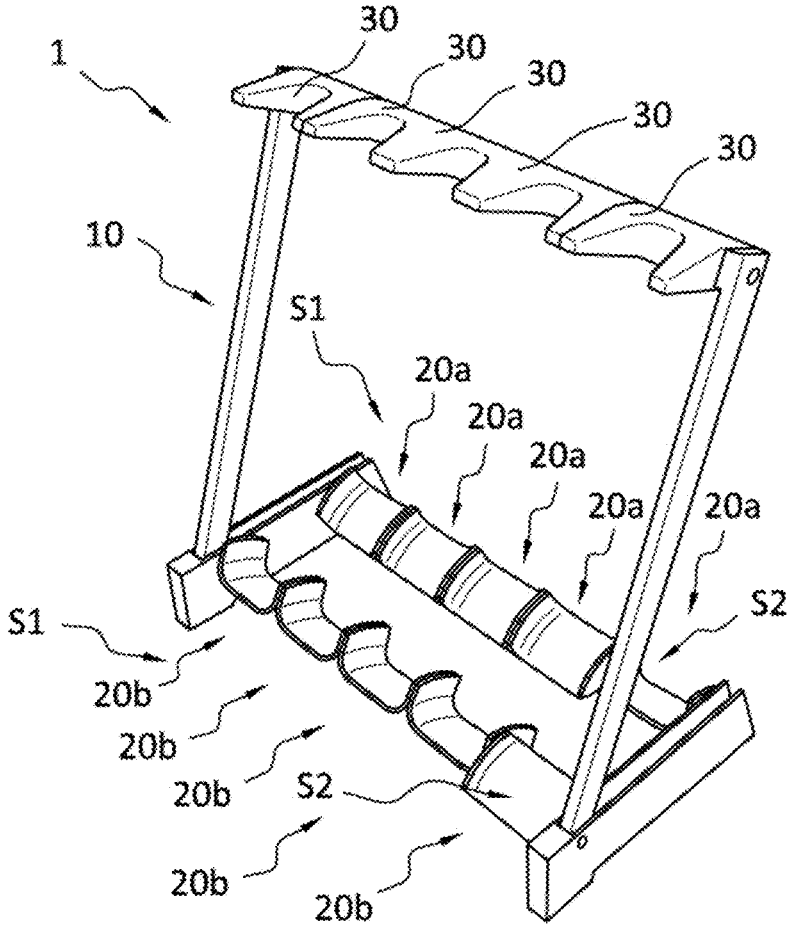
FIG. 16*b* is a musical instrument stand according to FIG. 16*a* with five pairs of support elements according to the invention.

A musical instrument stand 1 or its assembly (see arrow in FIG. 16*a*) is depicted in FIGS. 16*a* and 16*b* with five pairs of support elements 20*a*, 20*b*, which functionally correspond to support elements 20*a*, 20*b* described in conjunction with FIGS. 1 to 4 but have an alternative form. Support elements 20*a*, 20*b* have dual curved hearing surfaces 210*a*, 210*b*, wherein the curvature is vertical to support rails 12*a*, 12*b* outwards (convex) and parallel to the direction of support rails 12*a*, 12*b* inwards (concave). This produces a smaller bearing surface of a musical instrument 2 on support elements 20*a*, 20*b*. Support elements 20*a*, 20*b* have a one-piece design and have a formed mounting recess 24 on their bottom side, which corresponds to cross-section shape Q1 of support rails 12*a*, 12*b*.

A musical instrument stand 1 according to the invention has the advantage of being able to be used more flexibly and therefore being easily adaptable to the individual needs of the musician, particularly in order to be able to safely hold various types of musical instruments 2, preferably guitars with round and V-shaped bodies.

At this point, it should be indicated that all aspects of the invention described above, viewed separately on their own and in each combination, particularly the details depicted in the drawings, are claimed as essential for the invention. Specialists are familiar with changes thereof.

LIST OF REFERENCE SIGNS

1 Musical instrument stand
2 Musical instrument, particularly a guitar
10 Rack
11 Support frame
12*a*, 12*b* Support rail
14 Contact bracket
15 Contact rail
16 Support arm
17 Support arm
18 Swivel joint
19 Crossbar
20*a*, 20*b* Support element
21*a*, 20*b* Center element
22*a*, 22*b* Side element
23*a*, 23*b* Side element
24 Mounting recess (of the support element)
25 Hollow body
26 Outer side
27 Support edge
28 inner support element
29 Outer cover element
30 Contact element
31 Contact surface
32, 31 Lateral contact surfaces
34 Mounting recess (of the contact-element)
41 Outer support arm profile
42 inner support arm profile
43 Latching, device
50 Locking mechanism
51 Bending element
52 Second engagement device, particularly a locking tab
53 Spring
54 Pair of contact tongues
55 Crossbar
56 Groove
57 Contact tongue ends
110 Base element
141 First engagement device, particularly a locking groove
190 Passage opening
191 Stand element
180 Axis
181 Circumferential groove
210 Edge profile
220 Edge profile
210*a*, 210*b* Support surface
220*a*, 220*b* Lateral support surface
230*a*, 210*b* Lateral support surface
271 Inner side surfaces
272 Outer side surfaces
290 Rail recess
Q1 Cross-section shape (of the support rail)
Q2 Cross-section shape (of the contact rail)
A Symmetrical axis (of the mounting recess of the support rail)
B Pivot axis
M Center axis (of the support element)
E Bearing plane
S1 First support arrangement (of the support element)
S2 Second support arrangement (of the support element)
P1 First end position (of the contact bracket)
P2 Second end position (of the contact bracket)

What is claimed:

1. A musical instrument stand (1) for holding at least one of a first type musical instrument having a body and a neck or a second type musical instrument having a body and a neck, wherein the musical instrument stand (1) comprises a rack (10) and at least one pair of support elements (20*a*, 20*b*)

capable of being mounted on the rack (10) each with one support surface (210*a*, 210*b*) for the body of the musical instrument, wherein the rack (10) has a support frame (11) with two support rails (12*a*, 12*b*) running parallel to each other having a non-rotationally symmetrical, cross-sectional shape (Q1) and a contact bracket (14) connected to the support frame (11), wherein the contact bracket (14) has a contact rail (15) running parallel to the support rails (12*a*, 12*b*) and at least one support arm (16, 17) connecting the contact rail (15) to the support frame (11), wherein the contact rail (15) defines at least one contact surface (31) for the neck of the musical instrument, wherein the support elements (20*a*, 20*b*) each have one mounting recess (24) adapted to the cross-sectional shape (Q1) of the support rails (12, 12*b*) for fastening each of the support elements (20*a*, 20*b*) to respective one of the support rails (12*a*, 12*b*) in at least one support arrangement (S1, S2), and wherein each of the support elements (20*a*, 20*b*) is rotatably mountable on the support rails (12*a*, 12*b*) in a first support arrangement (S1) and a second support arrangement (S2), wherein the first support arrangement (S1) and second support arrangement (S2) are different from each other, wherein the first support arrangement (S1) is dimensioned and configured to the body of the first type musical instrument and second support arrangement (S2) is dimensioned and configured to the body of the second type musical instrument.

2. The musical instrument stand (1) according to claim 1, wherein each of the support elements (20*a*, 20*b*) is capable of being mounted on the support rails (12*a*, 12*b*) in the first support arrangement (S1) by being rotated relative to the support rails (12*a*, 12*b*), and the second support arrangement (S2) by being rotated relative to the support rails (12*a*, 12*b*), wherein the first support arrangement (S1) and the second support arrangement (S2) are turned away from each other by an angle between 60° and 120°.

3. The musical instrument stand (1) according to claim 1, wherein each of the support surfaces (210*a*, 210*b*) defines a support plane (E), which runs diagonally, turned between 30° and 60° with respect to a symmetrical axis (A) of the mounting recess (24).

4. The musical instrument stand (1) according to claim 1, wherein each mounting recess (24) is arranged eccentrically in a support element (20*a*, 20*b*), displaced with respect to a center axis (M) of said support element (20*a*, 20*b*).

5. The musical instrument stand (1) according to claim 1, further comprising contact elements (30) capable of being mounted on the contact rail (15), wherein the contact rail (15) has a non-rotationally symmetrical cross-sectional shape (Q2), wherein each contact element (30) has a mounting recess (34) for mounting the contact element (30) on the contact rail (15) that is adapted to the cross-sectional shape (Q2) of said contact rail (15).

6. The musical instrument stand (1) according to claim 5, wherein the mounting recesses (24) of the support elements (20*a*, 20*b*) and the mounting recess (34) of the contact element (30) are designed as a passage opening or a spring clip, wherein each of the support elements (20*a*, 20*b*) can be pushed onto the support rail (12*a*, 12*b*) and the contact element (30) can be pushed on the contact rail (15) in the longitudinal direction or clamped thereon in the transverse direction.

7. The musical instrument stand (1) according to claim 1, wherein each of the support elements (20*a*, 20*b*) forms a center support surface (210*a*, 210*b*) for supporting the body of the musical instrument and two opposing lateral support surfaces (220*a*, 220*b* or 230*a*, 230*b*) for restricting the lateral movement of the body of the musical instrument.

8. The musical instrument stand (1) according to claim 7, wherein each of the support elements (20*a*, 20*b*) has a greater rigidity in the mounting recess (24), than in the area of the center support surface (210*a*, 210*b*) or in the area of the lateral support surfaces (220*a*, 220*b* or 230*a*, 230*b*).

9. The musical instrument stand (1) according to claim 7, wherein each of the support elements (20*a*, 20*b*) has one center element (21*a*, 21*b*) and two side elements (22*a*, 22*b* or 23*a*, 23*b*) arranged on both sides of the center element (21*a*, 21*b*) that are capable of being connected to the center element (21*a*, 21 *b*), wherein the center element (21*a*, 21*b*) forms the center support surface (210*a*, 210*b*) and the lateral support surfaces (220*a*, 230*a*, 220*b*, 230*b*), wherein the center element (21*a*, 21*b*) is soft and elastic.

10. The musical instrument stand (1) according to claim 9, wherein a side element (22*a*, 22*b* or 23*a*, 23*b*) forms the mounting recess (24), wherein the side element (22*a*, 22*b* or 23*a*, 23*b*) is bend-resistant or torsion-resistant, wherein the side element (22*a*, 22*b* or 23*a*, 23*b*) is made of a thermoplastic.

11. The musical instrument stand (1) according to claim 10, wherein the thermoplastic is a polyamide.

12. The musical instrument stand (1) according to claim 9, wherein the center element (21*a*, 21*b*) can be connected to a side element (22*a*, 22*b* or 23*a*, 23*b*) on an outer side surface (272) via a twist-proof form-locking connection, by stepped, edge profiles (210, 220).

13. The musical instrument stand (1) according to claim 9, wherein the center element (21*a*, 21*b*) comprises a hollow body (25) that is open on both sides in the longitudinal direction, wherein in a central area of the hollow body (25) on an outer side (26) support surface (210*a*, 210*b*) and a support edge (27) protruding in at least one lateral area of the hollow body (25) with respect to the support surface (210*a*, 210*b*) forms lateral, support surfaces (220*a*, 230*a*, 220*b*, 230*b*).

14. The musical instrument stand (1) according to claim 9, wherein the center element (21*a*, 21*b*) is made of an elastomer.

15. The musical instrument stand (1) according to claim 14, wherein the elastomer is a thermoplastic elastomer (TPE).

16. The musical instrument stand (1) according to claim 7, wherein each of the support elements (20*a*, 20*b*) has an inner bearing element (28), which forms the mounting recess (24), and an outer cover element (29) that can be mounted to the inner bearing element (28), which forms the central support surfaces (210*a*, 210*b* and the lateral support surfaces (220*a*, 220*b* or 230*a*, 230*b*), wherein the inner bearing element (28) is bend-resistant or torsion-resistant and the cover element (29) is designed to be soft and elastic.

17. The musical instrument stand (1) according to claim 1, wherein each of the support elements (20*a*, 20*b*) is mountable on the support rail (12*a*, 12*b*) having a non-rotationally symmetrical cross-sectional shape (Q).

* * * * *